US011637391B2

(12) United States Patent
Guo et al.

(10) Patent No.: US 11,637,391 B2
(45) Date of Patent: Apr. 25, 2023

(54) CARD EDGE CONNECTOR WITH STRENGTH MEMBER, AND CIRCUIT BOARD ASSEMBLY

(71) Applicant: Amphenol Commercial Products (Chengdu) Co., Ltd., Chengdu (CN)

(72) Inventors: Bryan Guo, Chengdu (CN); Xiaodong Hu, Chengdu (CN)

(73) Assignee: Amphenol Commercial Products (Chengdu) Co., Ltd., Chengdu (CN)

( * ) Notice: Subject to any disclaimer, the term of this patent is extended or adjusted under 35 U.S.C. 154(b) by 35 days.

(21) Appl. No.: 17/199,204

(22) Filed: Mar. 11, 2021

(65) Prior Publication Data

US 2021/0288423 A1 Sep. 16, 2021

(30) Foreign Application Priority Data

Mar. 13, 2020 (CN) ..... 202010175212.9
Mar. 13, 2020 (CN) ..... 202020321875.2
Jul. 17, 2020 (CN) ..... 202021417991.0

(51) Int. Cl.
*H01R 12/72* (2011.01)

(52) U.S. Cl.
CPC ..... *H01R 12/721* (2013.01)

(58) Field of Classification Search
CPC ..... H01R 12/721
(Continued)

(56) References Cited

U.S. PATENT DOCUMENTS 2,996,710 A 8/1961 Pratt
3,002,162 A 9/1961 Garstang
(Continued)

FOREIGN PATENT DOCUMENTS

CN 1175101 A 3/1998
CN 1179448 C 12/2004
(Continued)

OTHER PUBLICATIONS

Extended European Search Report for European Application No. EP 11166820.8 dated Jan. 24, 2012.
(Continued)

*Primary Examiner* — Peter G Leigh
(74) *Attorney, Agent, or Firm* — Wolf, Greenfield & Sacks, P.C.

(57) ABSTRACT

A miniaturized card edge connector providing reliable operation. A connector may have a reinforcing member comprising a main body, a first connector engaging portion and a second connector engaging portion. The first connector engaging portion and the second connector engaging portion extend from the main body in a first vertical direction and are spaced apart in a transverse direction. The first connector engaging portion and the second connector engaging portion are configured to be engaged to both sides of a card slot of the electrical connector. The reinforcing member may effectively protect the insulating body of the electrical connector against deformation or even damage. The reinforcing member can strengthen the connection between the electrical connector and the circuit board to ensure their stable connection. Since the reinforcing member itself is
(Continued)

multifunctional and is convenient for mounting, the assembly period may be shortened and the product cost may be lowered.

26 Claims, 16 Drawing Sheets

(58) Field of Classification Search
USPC ..... 439/630, 629
See application file for complete search history.

(56) References Cited

U.S. PATENT DOCUMENTS 3,134,950 A 5/1964 Cook
3,322,885 A 5/1967 May et al.
3,573,706 A 4/1971 Haberlen
3,786,372 A 1/1974 Epis et al.
3,825,874 A 7/1974 Peverill
3,863,181 A 1/1975 Glance et al.
3,970,353 A 7/1976 Kaufman
4,155,613 A 5/1979 Brandeau
4,195,272 A 3/1980 Boutros
4,276,523 A 6/1981 Boutros et al.
4,371,742 A 2/1983 Manly
4,408,255 A 10/1983 Adkins
4,447,105 A 5/1984 Ruehl
4,471,015 A 9/1984 Ebneth et al.
4,484,159 A 11/1984 Whitley
4,487,468 A 12/1984 Fedder et al.
4,490,283 A 12/1984 Kleiner
4,518,651 A 5/1985 Wolfe, Jr.
4,519,664 A 5/1985 Tillotson
4,519,665 A 5/1985 Althouse et al.
4,632,476 A 12/1986 Schell
4,636,752 A 1/1987 Saito
4,682,129 A 7/1987 Bakermans et al.
4,751,479 A 6/1988 Parr
4,761,147 A 8/1988 Gauthier
4,806,107 A 2/1989 Arnold et al.
4,846,724 A 7/1989 Sasaki et al.
4,846,727 A 7/1989 Glover et al.
4,878,155 A 10/1989 Conley
4,948,922 A 8/1990 Varadan et al.
4,970,354 A 11/1990 Iwasa et al.
4,975,084 A 12/1990 Fedder et al.
4,992,060 A 2/1991 Meyer
5,000,700 A 3/1991 Masubuchi et al.
5,066,236 A 11/1991 Broeksteeg
5,141,454 A 8/1992 Garrett et al.
5,150,086 A 9/1992 Ito
5,166,527 A 11/1992 Solymar
5,168,252 A 12/1992 Naito
5,168,432 A 12/1992 Murphy et al.
5,176,538 A 1/1993 Hansell, III et al.
5,266,055 A 11/1993 Naito et al.
5,280,257 A 1/1994 Cravens et al.
5,287,076 A 2/1994 Johnescu et al.
5,334,050 A 8/1994 Andrews
5,340,334 A 8/1994 Nguyen
5,346,410 A 9/1994 Moore, Jr.
5,393,247 A * 2/1995 DiOrazio ..... H01R 12/7064 411/510
5,429,520 A 7/1995 Morlion et al.
5,429,521 A 7/1995 Morlion et al.
5,433,617 A 7/1995 Morlion et al.
5,433,618 A 7/1995 Morlion et al.
5,456,619 A 10/1995 Belopolsky et al.
5,461,392 A 10/1995 Mott et al.
5,474,472 A 12/1995 Niwa et al.
5,484,310 A 1/1996 McNamara et al.
5,496,183 A 3/1996 Soes et al.
5,499,935 A 3/1996 Powell
5,551,893 A 9/1996 Johnson
5,562,497 A 10/1996 Yagi et al.
5,597,328 A 1/1997 Mouissie
5,651,702 A 7/1997 Hanning et al.
5,669,789 A 9/1997 Law
5,796,323 A 8/1998 Uchikoba et al.
5,831,491 A 11/1998 Buer et al.
5,924,899 A 7/1999 Paagman
5,981,869 A 11/1999 Kroger
5,982,253 A 11/1999 Perrin et al.
6,019,616 A 2/2000 Yagi et al.
6,152,747 A 11/2000 McNamara
6,168,469 B1 1/2001 Lu
6,174,203 B1 1/2001 Asao
6,174,944 B1 1/2001 Chiba et al.
6,217,372 B1 4/2001 Reed
6,293,827 B1 9/2001 Stokoe
6,296,496 B1 10/2001 Trammel
6,299,438 B1 10/2001 Sahagian et al.
6,299,483 B1 10/2001 Cohen et al.
6,328,601 B1 12/2001 Yip et al.
6,347,962 B1 2/2002 Kline
6,350,134 B1 2/2002 Fogg et al.
6,364,711 B1 4/2002 Berg et al.
6,375,510 B2 4/2002 Asao
6,379,188 B1 4/2002 Cohen et al.
6,398,588 B1 6/2002 Bickford
6,409,543 B1 6/2002 Astbury, Jr. et al.
6,482,017 B1 11/2002 Van Doorn
6,503,103 B1 1/2003 Cohen et al.
6,506,076 B2 1/2003 Cohen et al.
6,517,360 B1 2/2003 Cohen
6,530,790 B1 3/2003 McNamara et al.
6,537,087 B2 3/2003 McNamara et al.
6,554,647 B1 4/2003 Cohen et al.
6,565,387 B2 5/2003 Cohen
6,579,116 B2 6/2003 Brennan et al.
6,582,244 B2 6/2003 Fogg et al.
6,595,802 B1 7/2003 Watanabe et al.
6,602,095 B2 8/2003 Astbury, Jr. et al.
6,616,864 B1 9/2003 Jiang et al.
6,638,105 B1 * 10/2003 Wu ..... H01R 12/7029 439/567
6,648,682 B1 * 11/2003 Wu ..... H01R 12/7029 439/567
6,652,318 B1 11/2003 Winings et al.
6,655,966 B2 12/2003 Rothermel et al.
6,709,294 B1 3/2004 Cohen et al.
6,713,672 B1 3/2004 Stickney
6,743,057 B2 6/2004 Davis et al.
6,776,659 B1 8/2004 Stokoe et al.
6,786,771 B2 9/2004 Gailus
6,814,619 B1 11/2004 Stokoe et al.
6,830,489 B2 12/2004 Aoyama
6,872,085 B1 3/2005 Cohen et al.
6,979,226 B2 12/2005 Otsu et al.
7,008,250 B2 3/2006 Shuey et al.
7,044,794 B2 5/2006 Consoli et al.
7,057,570 B2 6/2006 Irion, II et al.
7,074,067 B2 7/2006 Yang et al.
7,074,086 B2 7/2006 Cohen et al.
7,094,102 B2 8/2006 Cohen et al.
7,108,556 B2 9/2006 Cohen et al.
7,163,421 B1 1/2007 Cohen et al.
7,285,018 B2 10/2007 Kenny et al.
7,335,063 B2 2/2008 Cohen et al.
7,467,977 B1 12/2008 Yi et al.
7,494,383 B2 2/2009 Cohen et al.
7,540,781 B2 6/2009 Kenny et al.
7,581,990 B2 9/2009 Kirk et al.
7,588,464 B2 9/2009 Kim
7,637,783 B2 12/2009 Sasaoka et al.
7,677,907 B2 3/2010 Guan et al.
7,699,644 B2 4/2010 Szczesny et al.
7,722,401 B2 5/2010 Kirk et al.
7,731,537 B2 6/2010 Amleshi et al.
7,753,731 B2 7/2010 Cohen et al.
7,771,233 B2 8/2010 Gailus
7,794,240 B2 9/2010 Cohen et al.
7,794,278 B2 9/2010 Cohen et al.
7,806,729 B2 10/2010 Nguyen et al.
7,874,873 B2 1/2011 Do et al.

(56) References Cited

U.S. PATENT DOCUMENTS 7,887,371 B2 2/2011 Kenny et al.
7,887,379 B2 2/2011 Kirk
7,892,006 B2 * 2/2011 Guan ..... H01R 12/707 439/328
7,906,730 B2 3/2011 Atkinson et al.
7,914,304 B2 3/2011 Cartier et al.
7,972,171 B2 * 7/2011 Teh ..... H01R 12/721 439/570
7,985,097 B2 7/2011 Gulla
8,083,553 B2 12/2011 Manter et al.
8,182,289 B2 5/2012 Stokoe et al.
8,187,031 B2 * 5/2012 Li ..... H01R 12/737 439/567
8,215,968 B2 7/2012 Cartier et al.
8,216,001 B2 7/2012 Kirk
8,272,877 B2 9/2012 Stokoe et al.
8,348,701 B1 1/2013 Lan et al.
8,371,875 B2 2/2013 Gailus
8,382,524 B2 2/2013 Khilchenko et al.
8,403,689 B2 3/2013 Li et al.
8,535,077 B2 * 9/2013 Shen ..... H01R 13/6275 439/328
8,657,627 B2 2/2014 McNamara et al.
8,715,003 B2 5/2014 Buck et al.
8,771,016 B2 7/2014 Atkinson et al.
8,864,521 B2 10/2014 Atkinson et al.
8,926,377 B2 1/2015 Kirk et al.
8,944,831 B2 2/2015 Stoner et al.
8,998,642 B2 4/2015 Manter et al.
9,004,942 B2 4/2015 Paniauqa
9,022,806 B2 5/2015 Cartier, Jr. et al.
9,028,281 B2 5/2015 Kirk et al.
9,124,009 B2 9/2015 Atkinson et al.
9,219,335 B2 12/2015 Atkinson et al.
9,225,085 B2 12/2015 Cartier, Jr. et al.
9,300,074 B2 3/2016 Gailus
9,350,095 B2 5/2016 Arichika et al.
9,450,344 B2 9/2016 Cartier, Jr. et al.
9,484,674 B2 11/2016 Cartier, Jr. et al.
9,509,101 B2 11/2016 Cartier, Jr. et al.
9,520,689 B2 12/2016 Cartier, Jr. et al.
9,742,132 B1 8/2017 Hsueh
9,972,945 B1 5/2018 Huang et al.
10,103,476 B1 10/2018 Qiu et al.
10,122,129 B2 11/2018 Milbrand, Jr. et al.
10,135,165 B2 11/2018 Zuo
10,224,653 B2 * 3/2019 Niu ..... H01R 12/721
10,243,304 B2 3/2019 Kirk et al.
10,270,191 B1 4/2019 Li et al.
10,283,910 B1 5/2019 Chen et al.
10,348,040 B2 7/2019 Cartier, Jr. et al.
10,381,767 B1 8/2019 Milbrand, Jr. et al.
10,797,446 B2 10/2020 Liu et al.
11,381,015 B2 7/2022 Lu
2001/0042632 A1 11/2001 Manov et al.
2002/0042223 A1 4/2002 Belopolsky et al.
2002/0089464 A1 7/2002 Joshi
2002/0098738 A1 7/2002 Astbury et al.
2002/0111068 A1 8/2002 Cohen et al.
2002/0111069 A1 8/2002 Astbury et al.
2004/0005815 A1 1/2004 Mizumura et al.
2004/0020674 A1 2/2004 McFadden et al.
2004/0115968 A1 6/2004 Cohen
2004/0121652 A1 6/2004 Gailus
2004/0196112 A1 10/2004 Welbon et al.
2004/0259419 A1 12/2004 Payne et al.
2005/0070160 A1 3/2005 Cohen et al.
2005/0133245 A1 6/2005 Katsuyama et al.
2005/0176835 A1 8/2005 Kobayashi et al.
2005/0233610 A1 10/2005 Tutt et al.
2005/0283974 A1 12/2005 Richard et al.
2005/0287869 A1 12/2005 Kenny et al.
2006/0068640 A1 3/2006 Gailus
2006/0255876 A1 11/2006 Kushta et al.
2007/0004282 A1 1/2007 Cohen et al.
2007/0021001 A1 1/2007 Laurx et al.
2007/0037419 A1 2/2007 Sparrowhawk
2007/0042639 A1 2/2007 Manter et al.
2007/0054554 A1 3/2007 Do et al.
2007/0059961 A1 3/2007 Cartier et al.
2007/0218765 A1 9/2007 Cohen et al.
2008/0194146 A1 8/2008 Gailus
2008/0246555 A1 10/2008 Kirk et al.
2008/0248658 A1 10/2008 Cohen et al.
2008/0248659 A1 10/2008 Cohen et al.
2008/0248660 A1 10/2008 Kirk et al.
2009/0011641 A1 1/2009 Cohen et al.
2009/0011645 A1 1/2009 Laurx et al.
2009/0035955 A1 2/2009 McNamara
2009/0061661 A1 3/2009 Shuey et al.
2009/0117386 A1 5/2009 Vacanti et al.
2009/0239395 A1 9/2009 Cohen et al.
2009/0258516 A1 10/2009 Hiew et al.
2009/0291593 A1 11/2009 Atkinson et al.
2009/0305530 A1 12/2009 Ito et al.
2009/0305533 A1 12/2009 Feldman et al.
2010/0048058 A1 2/2010 Morgan et al.
2010/0075538 A1 3/2010 Ohshida
2010/0081302 A1 4/2010 Atkinson et al.
2010/0294530 A1 11/2010 Atkinson et al.
2011/0003509 A1 1/2011 Gailus
2011/0065297 A1 3/2011 Guan et al.
2011/0067237 A1 3/2011 Cohen et al.
2011/0104948 A1 5/2011 Girard, Jr. et al.
2011/0143605 A1 6/2011 Pepe
2011/0212649 A1 9/2011 Stokoe et al.
2011/0212650 A1 9/2011 Amleshi et al.
2011/0230095 A1 9/2011 Atkinson et al.
2011/0230096 A1 9/2011 Atkinson et al.
2011/0256739 A1 10/2011 Toshiyuki et al.
2011/0275238 A1 11/2011 Iijima et al.
2011/0287663 A1 11/2011 Gailus et al.
2012/0094536 A1 4/2012 Khilchenko et al.
2012/0156929 A1 6/2012 Manter et al.
2012/0178274 A1 7/2012 Manickam
2012/0184154 A1 7/2012 Frank et al.
2012/0202363 A1 8/2012 McNamara et al.
2012/0202386 A1 8/2012 McNamara et al.
2012/0214344 A1 8/2012 Cohen et al.
2013/0012038 A1 1/2013 Kirk et al.
2013/0017733 A1 1/2013 Kirk et al.
2013/0078870 A1 3/2013 Milbrand, Jr.
2013/0109232 A1 5/2013 Paniaqua
2013/0196553 A1 8/2013 Gailus
2013/0217263 A1 8/2013 Pan
2013/0225006 A1 8/2013 Khilchenko et al.
2013/0280926 A1 10/2013 Ono
2013/0316590 A1 11/2013 Hon
2014/0004724 A1 1/2014 Cartier, Jr. et al.
2014/0004726 A1 1/2014 Cartier, Jr. et al.
2014/0004746 A1 1/2014 Cartier, Jr. et al.
2014/0057498 A1 2/2014 Cohen
2014/0273557 A1 9/2014 Cartier, Jr. et al.
2014/0273627 A1 9/2014 Cartier, Jr. et al.
2014/0377992 A1 12/2014 Chang et al.
2015/0056856 A1 2/2015 Atkinson et al.
2015/0111427 A1 4/2015 Wu et al.
2015/0236451 A1 8/2015 Cartier, Jr. et al.
2015/0236452 A1 8/2015 Cartier, Jr. et al.
2015/0255926 A1 9/2015 Paniagua
2016/0149343 A1 5/2016 Atkinson et al.
2017/0352970 A1 12/2017 Liang et al.
2018/0062323 A1 3/2018 Kirk et al.
2018/0145438 A1 5/2018 Cohen
2018/0205177 A1 7/2018 Zhou et al.
2018/0212376 A1 7/2018 Wang et al.
2018/0219331 A1 8/2018 Cartier, Jr. et al.
2018/0269607 A1 9/2018 Wu et al.
2018/0331444 A1 11/2018 Ono
2019/0052019 A1 2/2019 Huang et al.
2019/0067854 A1 2/2019 Ju et al.
2019/0173209 A1 6/2019 Lu et al.
2019/0173232 A1 6/2019 Lu et al.
2019/0199023 A1 * 6/2019 Soh ..... H01R 12/7011

(56) References Cited

U.S. PATENT DOCUMENTS

| | | | |
|---|---|---|---|
| 2020/0203867 | A1 | 6/2020 | Lu |
| 2021/0376508 | A1 | 12/2021 | Hu |
| 2022/0037828 | A1 | 2/2022 | Hu et al. |
| 2022/0069496 | A1 | 3/2022 | Yi et al. |
| 2022/0181811 | A1 | 6/2022 | Liu et al. |

FOREIGN PATENT DOCUMENTS

| | | | |
|---|---|---|---|
| CN | 1799290 | A | 7/2006 |
| CN | 101176389 | A | 5/2008 |
| CN | 101600293 | A | 12/2009 |
| CN | 101790818 | A | 7/2010 |
| CN | 101120490 | B | 11/2010 |
| CN | 201846527 | U | 5/2011 |
| CN | 102239605 | A | 11/2011 |
| CN | 101600293 | B | 5/2012 |
| CN | 102598430 | A | 7/2012 |
| CN | 202395248 | U | 8/2012 |
| CN | 202633554 | U | 12/2012 |
| CN | 203660106 | U | 6/2014 |
| CN | 104409906 | A | 3/2015 |
| CN | 105703103 | A | 6/2016 |
| CN | 304240766 | S | 8/2017 |
| CN | 304245430 | S | 8/2017 |
| CN | 206712089 | U | 12/2017 |
| CN | 207677189 | U | 7/2018 |
| CN | 108539464 | A | 9/2018 |
| CN | 212874843 | U | 4/2021 |
| CN | 214505858 | U | 10/2021 |
| DE | 60216728 | T2 | 11/2007 |
| EP | 0820124 | A2 | 1/1998 |
| EP | 1 018 784 | | 7/2000 |
| EP | 1 779 472 | | 5/2007 |
| EP | 2 169 770 | A2 | 3/2010 |
| EP | 2 405 537 | | 1/2012 |
| GB | 227943 | A | 1/1925 |
| GB | 1272347 | A | 4/1972 |
| JP | H07-302649 | A | 11/1995 |
| JP | 2001-510627 | A | 7/2001 |
| JP | 2006-344524 | A | 12/2006 |
| MX | 9907324 | A1 | 8/2000 |
| TW | 200835073 | A | 8/2008 |
| TW | M475740 | U | 4/2014 |
| TW | M558481 | U | 4/2018 |
| TW | M558482 | U | 4/2018 |
| TW | M558483 | U | 4/2018 |
| TW | M559006 | U | 4/2018 |
| TW | M559007 | U | 4/2018 |
| TW | M560138 | U | 5/2018 |
| TW | M562507 | U | 6/2018 |
| TW | M565894 | Y | 8/2018 |
| TW | M565895 | Y | 8/2018 |
| TW | M565899 | Y | 8/2018 |
| TW | M565900 | Y | 8/2018 |
| TW | M565901 | Y | 8/2018 |
| WO | WO 88/05218 | A1 | 7/1988 |
| WO | WO 98/35409 | A1 | 8/1998 |
| WO | WO 02/073819 | A2 | 9/2002 |
| WO | WO 2004/059794 | A2 | 7/2004 |
| WO | WO 2004/059801 | A1 | 7/2004 |
| WO | WO 2006/039277 | A1 | 4/2006 |
| WO | WO 2007/005597 | A2 | 1/2007 |
| WO | WO 2007/005599 | A1 | 1/2007 |
| WO | WO 2008/124057 | A2 | 10/2008 |
| WO | WO 2010/030622 | A1 | 3/2010 |
| WO | WO 2010/039188 | A1 | 4/2010 |
| WO | WO 2017/007429 | A1 | 1/2017 |

OTHER PUBLICATIONS

International Search Report and Written Opinion for International Application No. PCT/CN2017/108344 dated Aug. 1, 2018.
International Search Report with Written Opinion for International Application No. PCT/US2006/025562 dated Oct. 31, 2007.
International Search Report and Written Opinion for International Application No. PCT/US2005/034605 dated Jan. 26, 2006.
International Preliminary Report on Patentability for International Application No. PCT/US2010/056482 dated May 24, 2012.
International Search Report and Written Opinion for International Application No. PCT/US2010/056482 dated Mar. 14, 2011.
International Preliminary Report on Patentability for International Application No. PCT/US2011/026139 dated Sep. 7, 2012.
International Search Report and Written Opinion for International Application No. PCT/US2011/026139 dated Nov. 22, 2011.
International Search Report and Written Opinion for International Application No. PCT/US2011/034747 dated Jul. 28, 2011.
International Preliminary Report on Patentability for International Application No. PCT/US2012/023689 dated Aug. 15, 2013.
International Search Report and Written Opinion for International Application No. PCT/US2012/023689 dated Sep. 12, 2012.
International Search Report and Written Opinion for International Application No. PCT/US2012/060610 dated Mar. 29, 2013.
International Search Report and Written Opinion for International Application No. PCT/US2015/012463 dated May 13, 2015.
International Search Report and Written Opinion for International Application No. PCT/US2017/047905 dated Dec. 4, 2017.
International Search Report and Written Opinion dated Nov. 29, 2021 for International Application No. PCT/CN2021/114671.
[No Author Listed], Carbon Nanotubes For Electromagnetic Interference Shielding. SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013.
[No Author Listed], DDR5 Memory Module Sockets (SMT). Storage & Server IO. Amphenol ICC. 2022. 2 pages. URL:https://cdn.amphenol-cs.com/media/wysiwyg/files/documentation/datasheet/ssio/ssio_ddr5_smt.pdf [last accessed Mar. 22, 2022].
[No Author Listed], DDR5 SDRAM—Wikipedia. Aug. 8, 2021. 6 pages. URL:https://en.wikipedia.org/wiki/DDR5_SDRAM [last accessed on Aug. 16, 2021].
[No Author Listed], MCIO 124pos 85ohm. Amphenol Assembletech. 1 page. URL:http://www.amphenol-ast.com/v3/en/overview.aspx?classId=234 [retrieved on Apr. 11, 2022].
[No Author Listed], Mini Cool Edge IO—The Ideal Solution to Transmit Next Generation High-Speed Signal to Designated Area in Your System. Jul. 25, 2018. 2 pages. URL:https://www.amphenol-icc.com/connect/mini-cool-edge-io-the-ideal-solution-to-transmit-next-generation-high-speedsignal.html [retrieved on Apr. 11, 2022].
[No Author Listed], Mini Cool Edge IO Connector. Commercial IO. Amphenol ICC. 5 pages. URL:https://cdn.amphenol-icc.com/media/wysiwyg/files/documentation/datasheet/inputoutput/io_mini_cool_edge_io.pdf [retrieved on Apr. 11, 2022].
Armasu, What We Know About DDR5 So Far. Jun. 7, 2019. 20 pages. URL: https://www.tomshardware.com/news/what-we-know-ddr5-ram,39079.html [last accessed Jul. 21, 2022].
Beaman, High Performance Mainframe Computer Cables. 1997 Electronic Components and Technology Conference. 1997;911-7.
Shi et al. Improving Signal Integrity in Circuit Boards by Incorporating Absorbing Materials. 2001 Proceedings. 51st Electronic Components and Technology Conference, Orlando FL. 2001:1451-56.

* cited by examiner

CARD EDGE CONNECTOR WITH STRENGTH MEMBER, AND CIRCUIT BOARD ASSEMBLY

CROSS-REFERENCE TO RELATED APPLICATIONS

This application claims priority to and the benefit of Chinese Patent Application No. 202021417991.0, filed on Jul. 17, 2020. This application also claims priority to and the benefit of Chinese Patent Application No. 202010175212.9, filed on Mar. 13, 2020. This application also claims priority to and the benefit of Chinese Patent Application No. 202020321875.2, filed on Mar. 13, 2020. The entire contents of these applications are incorporated herein by reference in their entirety.

TECHNICAL FIELD

The present disclosure relates to a reinforcing member, a card edge connector with the reinforcing member, a circuit board assembly with the card edge connector and an insulating body.

BACKGROUND

As a transmission medium, a card edge connector has been widely used in electronic products such as a computer, and it can be used for connecting electronic cards such as a memory card, a graphics card and a sound card to a circuit board, so that the electronic cards can provide the electronic products with some functions relating with greater memory capacity, improved operating speeds, etc. With the advent of the information age, people are using electronic products increasingly and putting forward more requirements on their functionality. Electronic cards and card edge connectors adopting new technology have been better satisfying people's needs.

Since an electronic card usually has a plate-like structure, a card edge connector for holding the electronic card includes an elongated insulating body with a slender card slot formed therein. An edge of the electronic card can be plugged into the card slot. The card edge connector also includes a number of conductive terminals disposed in the insulating body. After the electronic card is plugged into the card slot, conductive contacts on the electronic card are electrically connected to the conductive terminals on the card edge connector. The insulating body is usually made of plastic. In general, a partitioning rib is provided in the slender card slot. The partitioning rib can be connected between two slender side walls of the card slot in the middle part of the card slot, so as to enhance the mechanical strength of the card slot to a certain extent.

However, after the electronic card is plugged into the card slot, the insulating body still deforms or even cracks at the partitioning rib under the impact of an external force, resulting in poor contact between the electronic card and the circuit board and malfunctions of the electronic product.

BRIEF SUMMARY

In accordance with some embodiments, a reinforcing member is provided. The reinforcing member may comprise a main body, a first connector engaging portion and a second connector engaging portion. The first connector engaging portion and the second connector engaging portion extend from the main body in a first vertical direction and are spaced apart in a transverse direction. The first connector engaging portion and the second connector engaging portion are configured to be engaged to both sides of a card slot of the electrical connector respectively.

In one aspect, the main body may comprise an intermediate section, a first end section and a second end section. The first end section and the second end section may be connected to two ends of the intermediate section. The intermediate section may extend in the transverse direction. The first end section and the second end section may extend in a longitudinal direction. The first connector engaging portion and the second connector engaging portion may be connected to the first end section and the second end section respectively.

In another aspect, a first curved section may be connected between the first end section and the intermediate section, and a second curved section may be connected between the second end section and the intermediate section.

In another aspect, the first connector engaging portion may be L-shaped and comprises a first section and a second section that are perpendicular to each other. The first section may be connected to the first end section, and the second section may extend towards the first curved section and may be spaced apart from the first curved section. The second connector engaging portion may be L-shaped and comprise a third section and a fourth section that are perpendicular to each other. The third section may be connected to the second end section, and the fourth section may extend towards the second curved section and is spaced apart from the second curved section.

In another aspect, the size of the first section may be smaller than or equal to that of the first end section in the longitudinal direction, and/or the size of the third section may be smaller than or equal to that of the second end section in the longitudinal direction.

In another aspect, a maximum size of the first connector engaging portion may be greater than the sum of the sizes of the first end section and the first curved section in the longitudinal direction, and/or a maximum size of the second connector engaging portion may be greater than the sum of the sizes of the second end section and the second curved section in the longitudinal direction.

In another aspect, a vertical height of the main body may be greater than those of the first connector engaging portion and the second connector engaging portion.

In another aspect, the reinforcing member may further comprise a board engaging portion extending from the main body in a second vertical direction. The second vertical direction may be opposite to the first vertical direction. The board engaging portion may be configured to be engaged to a circuit board that the electrical connector is connected thereto.

In another aspect, the board engaging portion may be connected to the intermediate section.

In another aspect, the board engaging portion may extend in the transverse direction.

In another aspect, an end of the board engaging portion which is opposite to its end connected to the main body may be tapered in the second vertical direction.

In another aspect, ends of the first connector engaging portion and the second connector engaging portion, which are opposite to their ends connected to the main body respectively, may be tapered in the first vertical direction.

In another aspect, the reinforcing member may be an integral sheet metal part.

In yet another aspect, an electrical connector is provided, which may comprise an insulating body and any reinforcing member mentioned above. The insulating body may comprise an interfacing surface and a mounting surface that are arranged opposite to each other in a vertical direction. The insulating body may also comprise a card slot extending in a longitudinal direction in the interfacing surface and a first slot and a second slot in the mounting surface and respectively located on both sides of the card slot in the transverse direction. The first connector engaging portion and the second connector engaging portion may be inserted into the first slot and the second slot, respectively.

In another aspect, a partitioning rib may disposed in the card slot, and the first slot and the second slot are respectively located on both sides of the partitioning rib.

In another aspect, a connecting groove may be formed in the mounting surface and communicate between the first slot and the second slot, and the main body may be inserted into the connecting groove.

In another aspect, the mounting surface may be provided with a protruding rib extending in a direction in which the card slot extends. The first slot and the second slot may be respectively located on both sides of the protruding ribs. A distance between the first slot and the second slot may equal a width of the protruding ribs. The connecting groove may be formed in the protruding rib, and two ends of the main body may be against both sides of the protruding rib respectively.

In another aspect, the connecting groove may be formed in the partitioning rib.

In another aspect, the connecting groove may have a first notch and a second notch that are opposite to each other, and the first notch and the second notch may be formed at the mounting surface and in the middle part of the connecting groove.

In another aspect, two ends of the connecting groove may be respectively communicated with the middle parts of the first slot and the second slot in the longitudinal direction.

In another aspect, a depth of the connecting groove may be smaller than those of the first slot and the second slot.

In another aspect, both the first slot and the second slot may be blind slots.

In another aspect, at least one of the first slot and the second slot may extend from the mounting surface to the interfacing surface.

In another aspect, the electrical connector may be a card edge connector.

In yet another aspect, an electrical connector is provided, which may comprise an insulating body and a U-shaped reinforcing member. The insulating body may comprise an interfacing surface and a mounting surface that are arranged opposite to each other in a vertical direction. A card slot, a first slot and a second slot may be formed in the insulating body. The card slot formed in the interfacing surface may extend in a longitudinal direction, and the first slot and the second slot may run through the insulating body in the vertical direction and may be respectively located on both sides of the card slot in a transverse direction. A U-shaped reinforcing member may have two ends inserted into the first slot and the second slot respectively. Depth of the reinforcing member in the first slot and the second slot may correspond to a vertical height of the insulating body.

In another aspect, a partitioning rib may be disposed in the card slot, and the first slot and the second slot may be respectively located on both sides of the partitioning rib.

In another aspect, the reinforcing member may be plugged into the first slot and the second slot from the mounting surface.

In another aspect, the reinforcing member may comprise a main body, a first connector engaging portion and a second connector engaging portion. The first connector engaging portion and the second connector engaging portion may extend from the main body in a first vertical direction and may be spaced apart in the transverse direction to form the two ends of the reinforcing member, and respectively inserted into the first slot and the second slot. The first connector engaging portion and the second connector engaging portion each may have a greater size in the longitudinal direction than that in the transverse direction.

In another aspect, a connecting groove may be formed in the mounting surface and communicated between the first slot and the second slot, and the main body may be inserted into the connecting groove.

In another aspect, two ends of the connecting groove may be respectively communicated with the middle parts of the first slot and the second slot in the longitudinal direction.

In another aspect, a vertical height of the connecting groove may be greater than half of a vertical height of the first slot, and/or the vertical height of the connecting groove may be greater than half of a vertical height of the second slot.

In another aspect, the main body may comprise an intermediate section, a first end section and a second end section. The first end section and the second end section may be connected to two ends of the intermediate section and may extend in the longitudinal direction. The intermediate section may extend in the transverse direction. The first connector engaging portion and the second connector engaging portion may be connected to the first end section and the second end section respectively.

In another aspect, a first curved section may be connected between the first end section and the intermediate section, and a second curved section may be connected between the second end section and the intermediate section.

In another aspect, the first connector engaging portion may be L-shaped and comprises a first section and a second section that are perpendicular to each other. The first section may be connected to the first end section, and the second section may extend towards and beyond the intermediate section in the longitudinal direction. The second connector engaging portion may be L-shaped and comprises a third section and a fourth section that are perpendicular to each other. The third section may be connected to the second end section, and the fourth section may extend towards and beyond the intermediate section in the longitudinal direction.

In another aspect, the reinforcing member may further comprise a board engaging portion extending from the main body in a second vertical direction. The second vertical direction may be opposite to the first vertical direction. The board engaging portion may extend out of the insulating body from the mounting surface and may be configured to be engaged to a circuit board that the electrical connector is connected thereto.

In another aspect, the board engaging portion may be connected to the intermediate section.

In another aspect, the board engaging portion may extend in the transverse direction.

In another aspect, the electrical connector may be a card edge connector.

In another aspect, a circuit board assembly is provided, which may comprise a circuit board and any electrical connector mentioned above, wherein the electrical connector may be connected to the circuit board.

In yet another aspect, an insulating body is provided. The insulating body may comprise an interfacing surface and a mounting surface that are arranged opposite to each other in a vertical direction. A card slot extending in a longitudinal direction may be formed in the interfacing surface and configured to receive an electronic card. A first slot and a second slot may be formed in the mounting surface and respectively located on both sides of the card slot in a transverse direction.

In another aspect, the mounting surface may be provided with a protruding rib extending in a direction in which the card slot extends. The first slot and the second slot may be respectively located on both sides of the protruding rib. A distance between the first slot and the second slot may equal a width of the protruding rib. A connecting groove may be communicated between the first slot and the second slot and formed in the protruding rib.

In yet another aspect, at least one of the first slot and the second slot may extend from the mounting surface to the interfacing surface.

The foregoing aspects may be used separately or together, in a combination to two or more aspects. The advantages and features of the present disclosure will be described in detail below with reference to the accompanying drawings.

BRIEF DESCRIPTION OF DRAWINGS

The following accompanying drawings of the present disclosure are hereby provided as part of the present disclosure for the purpose of understanding the present disclosure. The drawings show the embodiments of the present disclosure to explain the principles of the present disclosure, in which.

Figure 1:
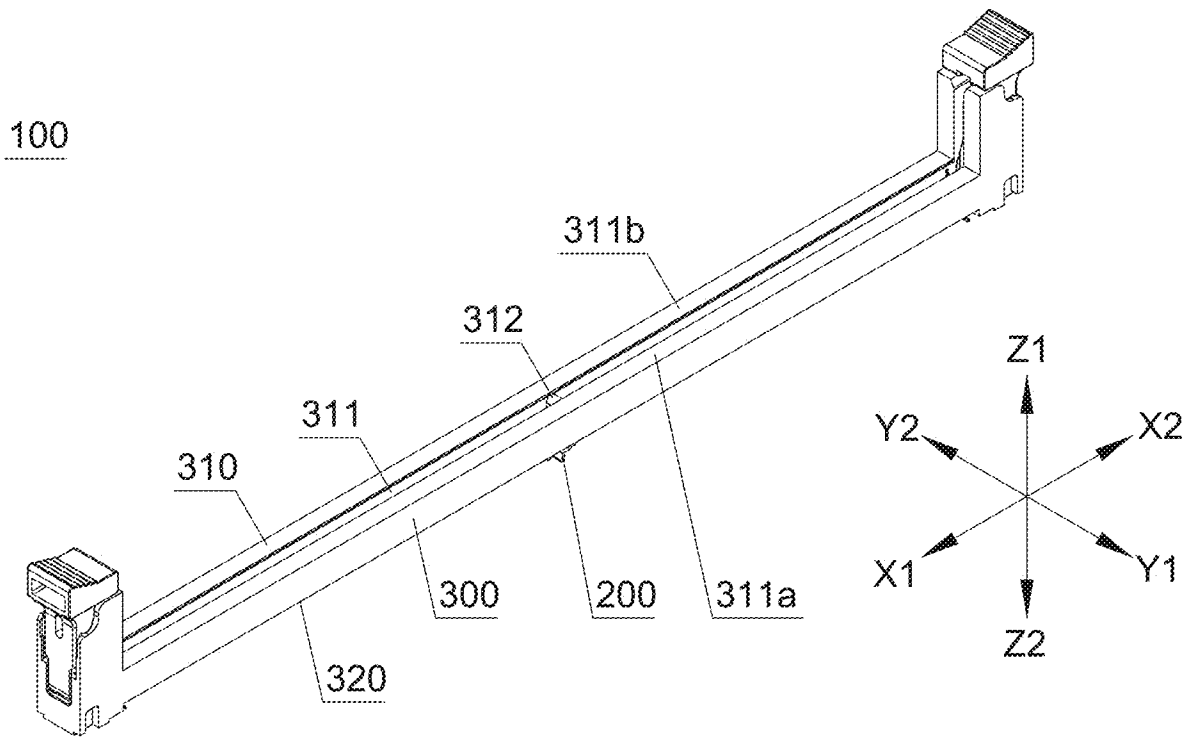
FIG. 1 is a perspective view of an electrical connector according to one exemplary embodiment of the present disclosure, in which a reinforcing member is mounted on an insulating body.

Reference numbers in the drawings are described as below:

100, 100'—electrical connector; 200, 200'—reinforcing member; 210—first connector engaging portion; 211—first section; 212—second section; 220—second connector engaging portion; 221—third section; 222—fourth section; 230—main body; 233—intermediate section; 231—first end section; 232—second end section; 234—first curved section; 235—second curved section; 240—board engaging portion; 300, 300'—insulating body; 310—interfacing surface; 311—card slot; 311*a*, 311*b*—side wall; 312—partitioning rib; 320—mounting surface; 321, 321'—first slot; 322, 322'—second slot; 323—connecting groove; 324—protruding rib; 325—first notch; 326—second notch; and 400—conductive terminal.

DETAILED DESCRIPTION

In the following description, a large number of details will be provided to enable a thorough understanding of the present disclosure. However, it is appreciated by those skilled in the art that the following descriptions merely exemplarily show preferred embodiments of the present disclosure, and the present disclosure may be implemented without one or more such details. In addition, in order to avoid confusion with the present disclosure, some technical features known in the art have not been described in detail.

The present disclosure relates to an electrical connector, which is suitable for use in miniaturized electronic devices where it provides reliable operation. Such an electrical connector with a reinforcing member and an insulating body, which may receive a circuit board. In some embodiments, the reinforcing member may comprise a main body, a first connector engaging portion and a second connector engaging portion. The first connector engaging portion and the second connector engaging portion extend from the main body in a first vertical direction and are spaced apart in a transverse direction. The first connector engaging portion and the second connector engaging portion are configured to be engaged to both sides of a card slot of the electrical connector. The reinforcing member may effectively protect the insulating body of the electrical connector against deformation or even damage. The reinforcing member can strengthen the connection between the electrical connector and the circuit board to ensure their stable connection. The reinforcing member itself may be multifunctional, as it is convenient for use in mounting the connector, the assembly period may be shortened and/or the product cost may be lowered.

Figure 2:
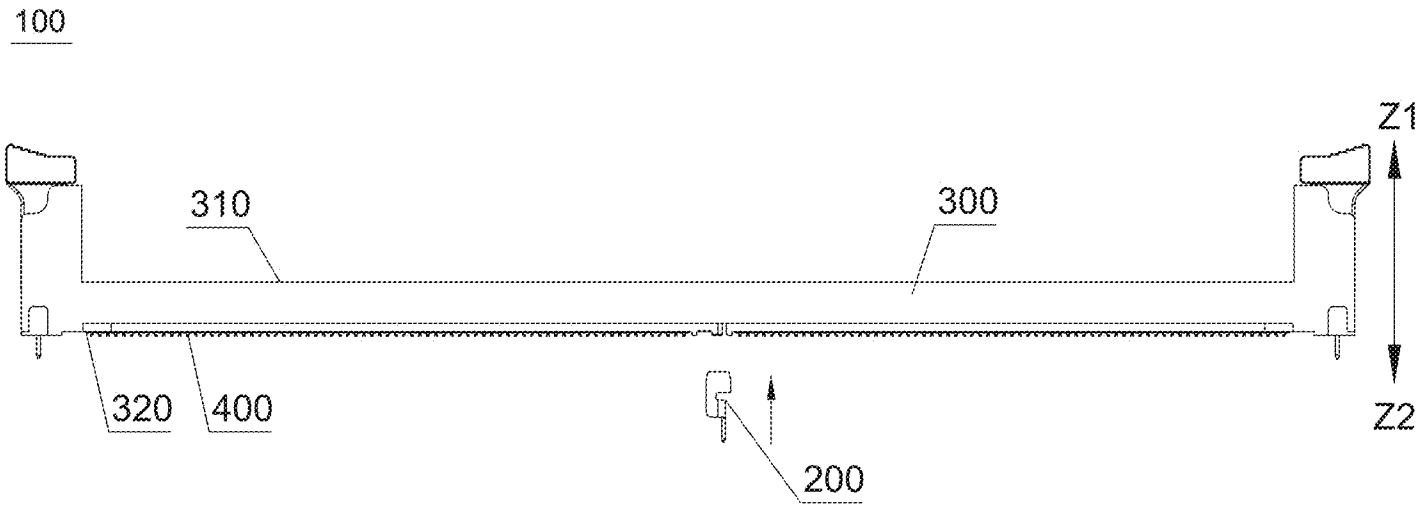
FIG. 2 is a front view of the electrical connector shown in FIG. 1, in which the reinforcing member has not been mounted on the insulating body.
Figure 3:
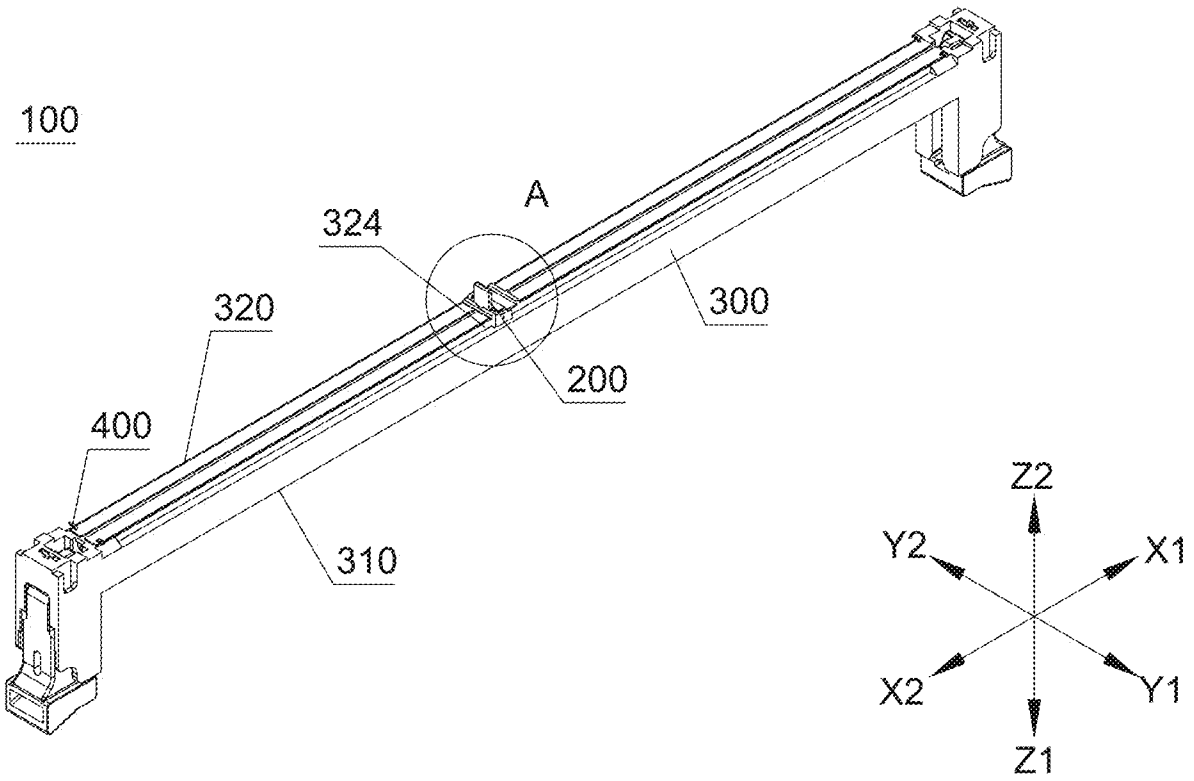
FIG. 3 is another perspective view of the electrical connector shown in FIG. 1.
Figure 4:
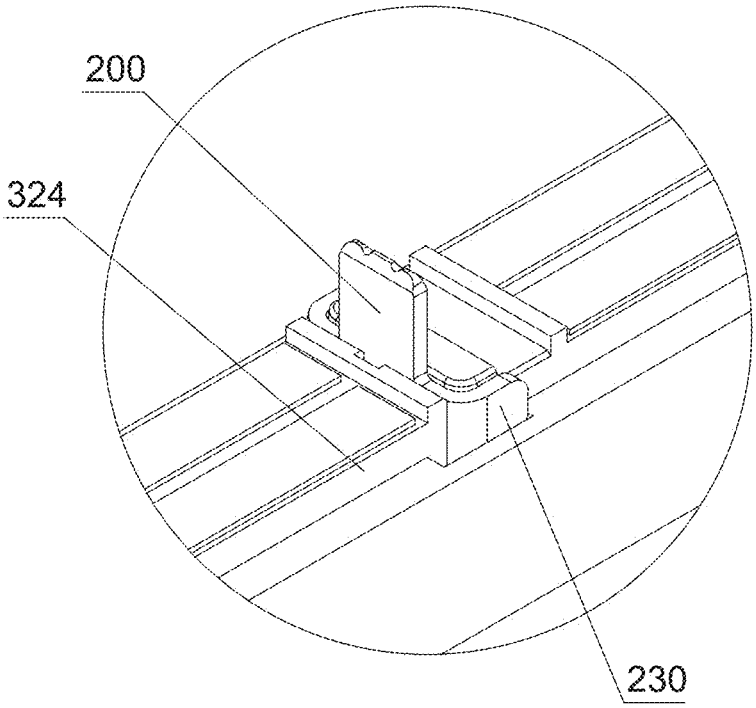
FIG. 4 is a partial enlarged view of the electrical connector shown in FIG. 3.

As shown in FIGS. 1 to 3, an electrical connector 100 is provided according to one aspect of the present disclosure. The electrical connector 100 may include an insulating body 300 and a reinforcing member 200. The electrical connector 100 may be a card edge connector. The card edge connector may be configured to connect electronic cards, such as a memory card, to another component such as a printed circuit board. The insulating body 300 may be mounted to a component as a circuit board. In an embodiment in which the insulating body 300 is mounted to a circuit board, conductive terminals 400 may be disposed on the insulating body 300 and configured to electrically connect the electronic card connected to the electrical connector 100 to the circuit board. Therefore, according to another aspect of the present disclosure, a circuit board assembly is also provided. The circuit board assembly may include a circuit board (not shown) and any electrical connector as described herein.

The insulating body 300 may be provided with an interfacing surface 310 and a mounting surface 320 that are arranged opposite to each other in a vertical direction Z1-Z2. The interfacing surface 310 faces the electronic card, and the mounting surface 320 faces the circuit board. The vertical direction is a direction in which the electronic card is plugged into the electrical connector 100, and the vertical direction is perpendicular to the circuit board. In the drawings, X1-X2 represents a longitudinal direction (i.e., a length direction) of the electrical connector 100; Y1-Y2 represents a transverse direction (i.e., a width direction) of the electrical connector 100; Z1-Z2 represents the vertical direction of the electrical connector 100 (i.e., a height direction). The longitudinal direction X1-X2, the transverse direction Y1-Y2 and the vertical direction Z1-Z2 are perpendicular to one another. A card slot 311 extending in the longitudinal direction X1-X2 may be formed in the interfacing surface 310. The card slot 311 is recessed inwards from the interfacing surface 310 to receive the electronic card. The card slot 311 substantially takes the shape of an elongated strip, as shown in FIG. 1. The electronic card may include any one of a graphics card, a memory card and a sound card.

With reference to FIGS. 1 to 2, the conductive terminals 400 are mounted in side walls 311*a* and 311*b* of the card slot 311. The card slot 311 exposes part of the conductive terminals 400. When the electronic card is plugged into the card slot 311, the exposed portions of the conductive terminals 400 may be electrically connected to conductive contacts of the electronic card. The conductive terminals 400 also extend to the mounting surface 320. In the case that the insulating body 300 is mounted to the circuit board, the conductive terminals 400 may be electrically connected to circuits in the circuit board. Thus, the conductive contacts of the electronic card are electrically connected to the circuits on the circuit board.

In the longitudinal direction X1-X2, a partitioning rib 312 may be provided in the middle part of the card slot 311, as shown in FIG. 1. The partitioning rib 312 is located in the card slot 311 and connects the two side walls 311*a* and 311*b* of the card slot 311. The electronic card has a notch that matches with the partitioning rib 312. The partitioning rib 312 is usually not disposed in the exact middle of the card slot 311 in its length direction, so the partitioning rib 312 also has a foolproof function. When plugged into the card slot 311, the electronic card may shake and strike the side walls 311*a* and 311*b* and the partitioning rib 312 under the impact of an external force, which may cause the insulating body 300 to deform or even crack.

Figure 7:
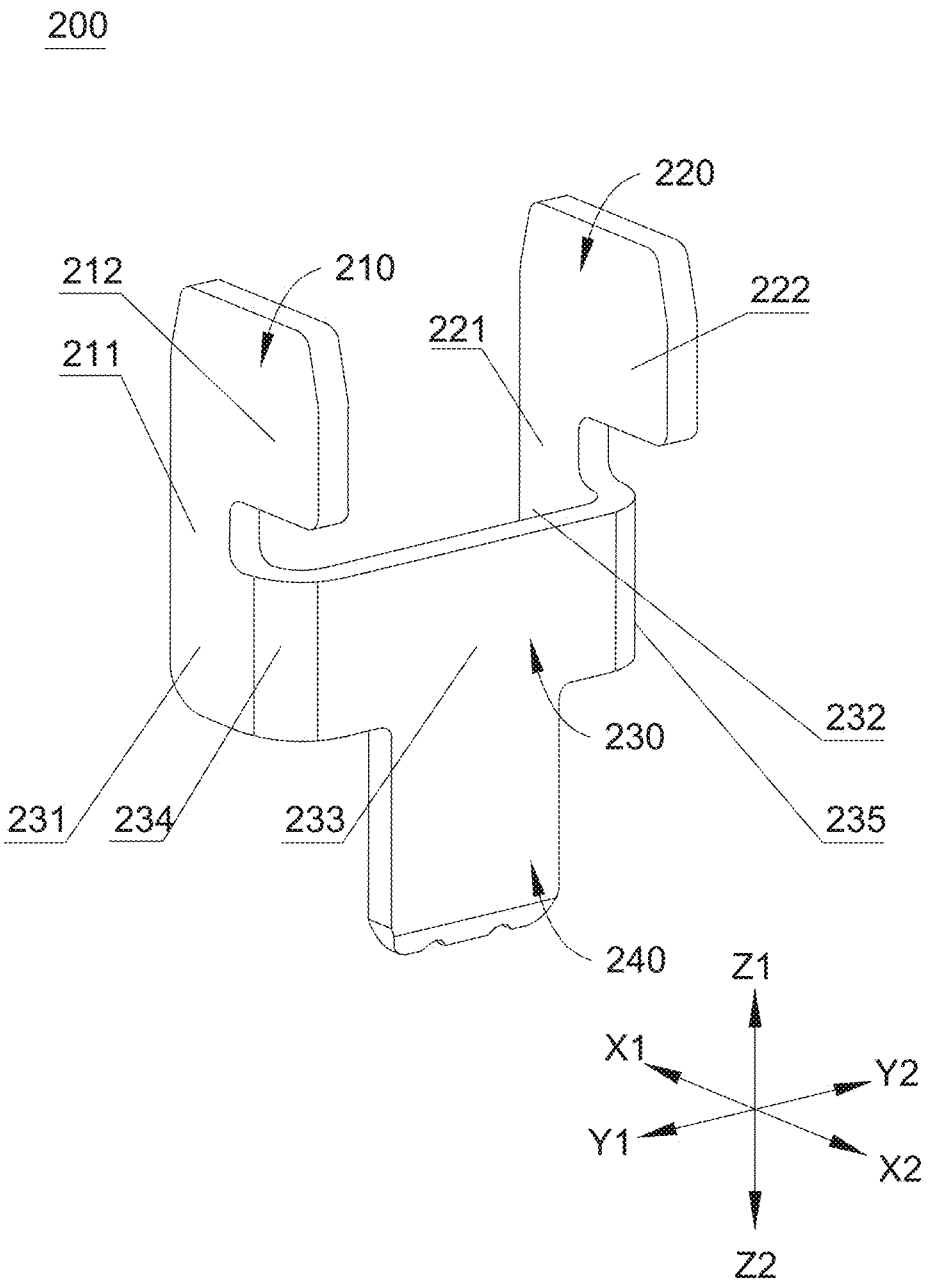
FIG. 7 is a perspective view of the reinforcing member shown in FIG. 1.

Based on this, the electrical connector 100 provided by some embodiments of the present disclosure further includes a reinforcing member 200 that may be of a U-shaped structure. As shown in FIG. 7, the reinforcing member 200 may include a main body 230, a first connector engaging portion 210 and a second connector engaging portion 220.

The first connector engaging portion 210 and the second connector engaging portion 220 may extend from the main body 230 in a first vertical direction Z1. The first connector engaging portion 210 and the second connector engaging portion 220 may be spaced apart in a transverse direction Y1-Y2. The first connector engaging portion 210 and the second connector engaging portion 220 may be inserted into the side walls 311*a* and 311*b* of the card slot 311 respectively. As an example, the first connector engaging portion 210 and the second connector engaging portion 220 may be connected with the main body 230 by means of, for example, welding, bonding, etc., or may be integrally formed with the main body 230.

In some embodiments, as shown in FIG. 7, the reinforcing member 200 may further include a board engaging portion 240 that may extend from the main body 230 in a second vertical direction Z2. The first vertical direction Z1 is opposite to the second vertical direction Z2 in the vertical direction Z1-Z2. The board engaging portion 240 may be inserted into the circuit board. For example, an engaging hole may be formed in the circuit board. The board engaging portion 240 of the reinforcing member 200 may be inserted into the engaging hole. The board engaging portion 240 may be connected with the main body 230 by means of, for example, welding, bonding, etc., or may be integrally formed with the main body 230.

The main body 230, the first connector engaging portion 210, the second connector engaging portion 220 and the board engaging portion 240 may be located within the same plane or different planes. In some embodiments, the first connector engaging portion 210 and the second connector engaging portion 220 have relatively larger sizes in a length direction of the card slot 311. Compared with an impact force in the length direction of the card slot 311, an impact force in a width direction of the card slot 311 is more likely to damage the card slot 311. The larger the sizes of the first connector engaging portion 210 and the second connector engaging portion 220 in the longitudinal direction X1-X2 are, the greater the resistance to the impact force in the transverse direction Y1-Y2 is. Therefore, the insulating body 300 may be better protected from cracking.

The reinforcing member 200 may be made of a high-strength material such as plastic, ceramic or metal. In some embodiments, the reinforcing member 200 is made of a metal material that has a high strength and low material and processing costs. In some embodiments, the reinforcing member 200 is an integral sheet metal part. In this way, the reinforcing member 200 is higher in strength, simpler in processing technology and lower in cost.

Figure 5:
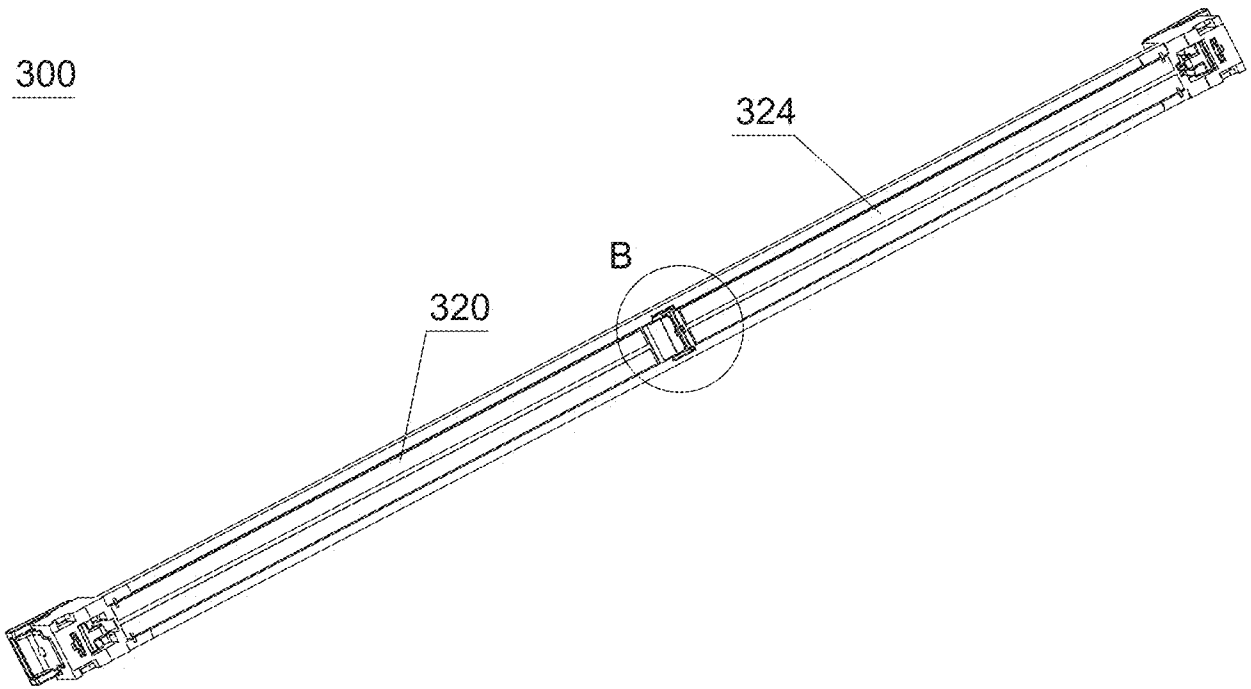
FIG. 5 is a perspective view of an insulating body of the electrical connector shown in FIG. 1.
Figure 6:
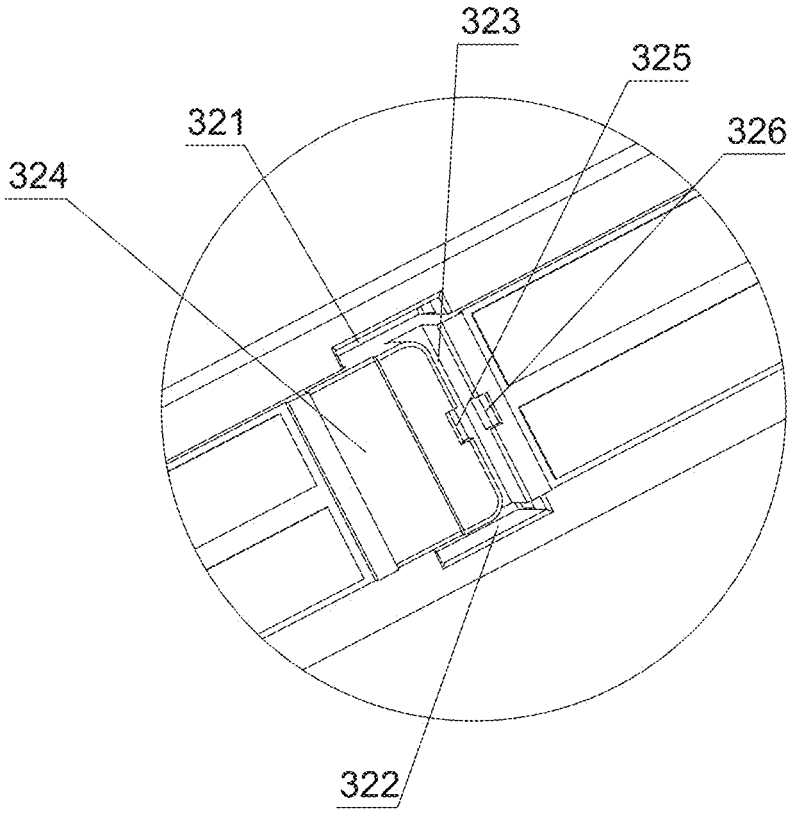
FIG. 6 is a partial enlarged view of the insulating body shown in FIG. 5.

In order to receive the first connector engaging portion 210 and the second connector engaging portion 220, a first slot 321 and a second slot 322 may be formed in the mounting surface 320 of the insulating body 300, with reference to FIGS. 5 and 6. The first slot 321 and the second slot 322 may be located on both sides of the card slot 311 in the transverse direction Y1-Y2. The first connector engaging portion 210 and the second connector engaging portion 220 are respectively inserted into the first slot 321 and the second slot 322 from the side where the mounting surface 320 is located. The arrow shown in FIG. 2 schematically shows the direction in which the reinforcing member 200 is plugged into the insulating body 300. The first slot 321 and the second slot 322 may be structurally adapted to the first connector engaging portion 210 and the second connector engaging portion 220 respectively, so that the first connector engaging portion 210 and the second connector engaging portion 220 may be limited in position after being inserted into the first slot 321 and the second slot 322 respectively.

By inserting the first connector engaging portion 210 and the second connector engaging portion 220 into the first slot 321 and the second slot 322 respectively, the side walls of the card slot 311 may be strengthened, which improves the impact resistance, particularly the resistance to the impact force in the width direction of the card slot 311. Thus, the insulating body 300 is protected against deforming or cracking to a certain extent.

The conductive terminals 400 may extend out from the mounting surface 320 of the electrical connector 100. By welding the conductive terminals 400 to the circuit board, the electrical connector 100 and the circuit board may be electrically connected. However, since the conductive terminals 400 are generally small, the structural strength at the welds is generally not high, and the welds are easy to be broken under the impact of an external force. By inserting the board engaging portion 240 of the reinforcing member 200 into the circuit board, for example, the engaging hole in the circuit board, the strength of connection between the electrical connector 100 and the circuit board may be enhanced to ensure that the electrical connector 100 and the circuit board are firmly connected. At the same time, the electrical connector 100 may also be positioned on the circuit board to guarantee accurate alignment between the conductive terminals 400 and points on the circuit board to be welded. Moreover, when the electronic card is connected to the circuit board by the electrical connector 100, impact forces on the electronic card and the insulating body 300 may be transmitted to the circuit board, effectively preventing the insulating body 300 from deforming and cracking under the impact forces.

Therefore, such a reinforcing member 200 may not only effectively protect the insulating body 300 of the electrical connector 100 against deformation or even damage but also strengthen the connection between the electrical connector 100 and the circuit board to ensure their stable connection. Since the reinforcing member 200 itself is multifunctional and is convenient for mounting, the assembly period may be shortened and the product cost may be lowered.

In some embodiments, as shown in FIG. 7, the reinforcing member 200 may be of the following structure: the main body 230 of the reinforcing member 200 may include an intermediate section 233, a first end section 231 and a second end section 232. The first end section 231 and the second end section 232 are connected to two ends of the intermediate section 233 respectively. The first end section 231 and the second end section 232 are connected to the two ends of the intermediate section 233. The first end section 231 and the second end section 232 may be connected with the intermediate section 233 by means of, for example, welding, bonding, etc., or may also be integrally formed with the intermediate section 233. The intermediate section 233 may extend in the transverse direction Y1-Y2. The first end section 231 and the second end section 232 may extend in the longitudinal direction X1-X2. In this way, viewed in the vertical direction Z1-Z2, the main body 230 is C-shaped. In the case that the reinforcing member 200 is mounted on the insulating body 300, the transverse direction Y1-Y2 is consistent with the width direction of the card slot 311, and the longitudinal direction X1-X2 is consistent with the length direction of the card slot 311.

The board engaging portion 240 may be connected to the intermediate section 233. The first connector engaging portion 210 and the second connector engaging portion 220 may be connected to the first end section 231 and the second end section 232 respectively. With this arrangement, the structural strength of the main body 230 is increased, so that the reinforcing member 200 has a better protective effect on the insulating body 300 of the electrical connector 100.

Furthermore, as shown in FIG. 7, optionally, the board engaging portion 240 may extend in the transverse direction Y1-Y2; and optionally, the first connector engaging portion 210 and the second connector engaging portion 220 may extend in the longitudinal direction X1-X2. In this way, the reinforcing member 200 is smaller in size, more compact in structure and convenient to process and manufacture. At the same time, the first connector engaging portion 210 and the second connector engaging portion 220 extend in the same direction as the card slot 311, such that the first connector engaging portion 210 and the second connector engaging portion 220 may resist the impact force within a longer size range in the length direction of the card slot 311. Thus, the mechanical strength of the insulating body 300 may be effectively improved, and the insulating body 300 may be protected better.

In some embodiments, as shown in FIG. 7, a first curved section 234 may be connected between the first end section 231 and the intermediate section 233. The first end section 231 and the intermediate section 233 are perpendicular to each other, and the first curved section 234 may serve as a rounded transition section between the first end section 231 and the intermediate section 233. In some embodiments, a second curved section 235 may be connected between the second end section 232 and the intermediate section 233. The second end section 232 and the intermediate section 233 are perpendicular to each other, and the second curved section 235 may serve as a rounded transition section between the second end section 232 and the intermediate section 233. The first curved section 234 and the second curved section 235 may have any radius of curvature. In this way, it is easier to process the main body 230 by a single plate, realizing a relatively lower production cost.

Optionally, as shown in FIG. 7, the first connector engaging portion 210 may be L-shaped and may include a first section 211 and a second section 212 that are perpendicular to each other. The first section 211 extends in the vertical direction Z1-Z2 and may be connected to the first end section 231. The second section 212 extends in the longitudinal direction X1-X2 and extends from the first section 211 towards the first curved section 234. In addition, the second section 212 and the first curved section 234 may be spaced apart in the vertical direction Z1-Z2. The first connector engaging portion 210 forms a C-shaped structure with the first end section 231 and the first curved section 234 of the main body 230. In the case that the reinforcing member 200 or the main body 230 is formed by a single plate, it may be conveniently manufactured by bending the plate to form the first curved section 234. In addition, since the second section 212 is wide enough in the longitudinal direction X1-X2, an excellent reinforcing role may be played to the insulating body 300. As the first connector engaging portion 210 is straight, it is convenient to form a slot in the relatively thin side wall 311*a* of the card slot 311 for receiving the first connector engaging portion 210. Moreover, compared with an embodiment in which the second section 212 extends from the first section 211 in a direction opposite to the direction shown in the drawings, the reinforcing member 200 with this structure saves more raw materials when processed and manufactured by a plate.

Optionally, the second connector engaging portion 220 may be L-shaped and may include a third section 221 and a fourth section 222 that are perpendicular to each other. The third section 221 extends in the vertical direction Z1-Z2 and may be connected to the second end section 232. The fourth section 222 extends in the longitudinal direction X1-X2 and extends from the third section 221 towards the second curved section 235. In addition, the fourth section 222 and the second curved section 235 may be spaced apart in the vertical direction Z1-Z2. The second connector engaging portion 220 may form a C-shaped structure with the second end section 232 and the second curved section 235 of the main body 230. A distance between the second section 212 and the first curved section 234 may equal or unequal that between the fourth section 222 and the second curved section 235. In the case that the reinforcing member 200 or the main body 230 is formed by a single plate, it may be conveniently manufactured by bending the plate to form the second curved section 235. In addition, since the fourth section 222 is wide enough in the longitudinal direction X1-X2, an excellent reinforcing role may be played to the insulating body 300. As the second connector engaging portion 220 is straight, it is convenient to form a slot in the relatively thin side wall 311*b* of the card slot 311 for receiving the second connector engaging portion 220. Moreover, compared with an embodiment in which the fourth section 222 extends from the third section 221 in a direction opposite to the direction shown in the drawings, the reinforcing member 200 with this structure saves more raw materials when processed and manufactured by a plate.

Optionally, as shown in FIG. 7, the size of the first section 211 may be smaller than or equal to that of the first end section 231 in the longitudinal direction X1-X2. The first section 211 does not extend to the first curved section 234, further ensuring that the first connector engaging portion 210 is straight. Optionally, the size of the third section 221 may be smaller than or equal to that of the second end section 232 in the longitudinal direction X1-X2. The third section 221 does not extend to the second curved section 235, further ensuring that the second connector engaging portion 220 is straight.

Optionally, as shown in FIG. 7, a maximum size of the first connector engaging portion 210 may be greater than the sum of the sizes of the first end section 231 and the first curved section 234 in the longitudinal direction X1-X2, i.e., the second section 212 may extend beyond the first curved section 234 from the first section 211. Thus, the second section 212 may be big enough in the longitudinal direction X1-X2, which improves the strengthening effect of the reinforcing member 200 on the insulating body 300. Moreover, in an embodiment in which the reinforcing member 200 is manufactured by a plate, it may make the best of the plate by adopting the above-mentioned structure on saving raw materials, on the premise of that the strengthening effect of the reinforcing member 200 on the insulating body 300 is enhanced.

Optionally, a maximum size of the second connector engaging portion 220 is greater than the sum of the sizes of the second end section 232 and the second curved section 235 in the longitudinal direction X1-X2, i.e., the fourth section 222 may extend beyond the second curved section 235 from the third section 221. Thus, the fourth section 222 may be big enough in the longitudinal direction X1-X2, which improves the strengthening effect of the reinforcing member 200 on the insulating body 300. Moreover, in an embodiment in which the reinforcing member 200 is manufactured by a plate, it may make the best of the plate by adopting the above-mentioned structure on saving raw materials, on the premise of that the strengthening effect of the reinforcing member 200 on the insulating body 300 is enhanced.

In some embodiments, as shown in FIG. 7, end portions (upper ends in the figure) of the first connector engaging portion 210 and the second connector engaging portion 220 which are opposite to their end portions (lower ends in the figure) connected to the main body 230 are tapered in the first vertical direction Z1. The tapered size may play a guiding role. In the process of mounting the reinforcing member 200 on the insulating body 300, the upper ends of the first connector engaging portion 210 and the second connector engaging portion 220 respectively enter the first slot 321 and the second slot 322 of the insulating body 300 first, and owing to their tapered upper ends, their mounting is convenient.

Similarly, an end portion (lower end in the figure) of the board engaging portion 240 which is opposite to an end portion (upper end in the figure) connected to the main body 230 is tapered in the second vertical direction Z2. The tapered size may play a guiding role. In the process of mounting the reinforcing member 200 on the circuit board, the lower end of the board engaging portion 240 enters the engaging hole of the circuit board first, and owing to the tapered lower end of the board engaging portion 240, its mounting is convenient.

Referring back to FIG. 1, in the case that the partitioning rib 312 is provided in the card slot 311, the first slot 321 and the second slot 322 may be located at the partitioning rib 312. The first slot 321 and the second slot 322 may be located on both sides of the partitioning rib 312 respectively. As mentioned above, the electronic card usually has a notch that matches with the partitioning rib 312, which may prevent the electronic card from being plugged in a wrong direction. At the same time, the partitioning rib 312 may also improve the structural strength of the card slot 311. When the insulating body 300 is impacted by an external force, the partitioning rib 312 may absorb a part of the external force. The partitioning rib 312 is usually solid and is of certain sizes in the length and width directions of the card slot 311. For some models of card edge connectors (e.g., a card edge connector for plugging a DDR5 memory card), the side walls 311*a* and 311*b* of the card slot 311 have relatively long solid sections at the partitioning rib 312, without any conductive terminal 400. Therefore, in terms of space and structure, it provides conditions for forming the first slot 321 and the second slot 322 for receiving the reinforcing member 200 because of the partitioning rib 312. When the inventor made vibration and impact tests on a conventional card edge connector without the reinforcing member 200, it was found that crack would happen at the partitioning rib 312. Therefore, disposing the reinforcing member 200 at the partitioning rib 312 may enhance the strength of the insulating body 300.

Certainly, for different models of card edge connectors, if spatially and structurally permitted, the first slot 321 and the second slot 322 may also be located at other positions of the insulating body 300 than at the partitioning rib 312. Besides, based on the structure of the insulating body 300, one or more reinforcing members 200 may be mounted thereon.

Referring to FIG. 7, in the vertical direction Z1-Z2, those skilled in the art may select vertical heights of the main body 230, the first connector engaging portion 210 and the second connector engaging portion 220 according to the position of the reinforcing member 200. In the case that the reinforcing member 200 is plugged at the position where the partitioning rib 312 is located, the vertical height of the main body 230 may be appropriately increased. At least part of the main body 230 may also be inserted into the insulating body 300, for example, into the partitioning rib 312. In the embodiment shown by the drawings, the main body 230 is basically inserted into the insulating body 300, and the exposed part is mainly the board engaging portion 240.

Figure 8:
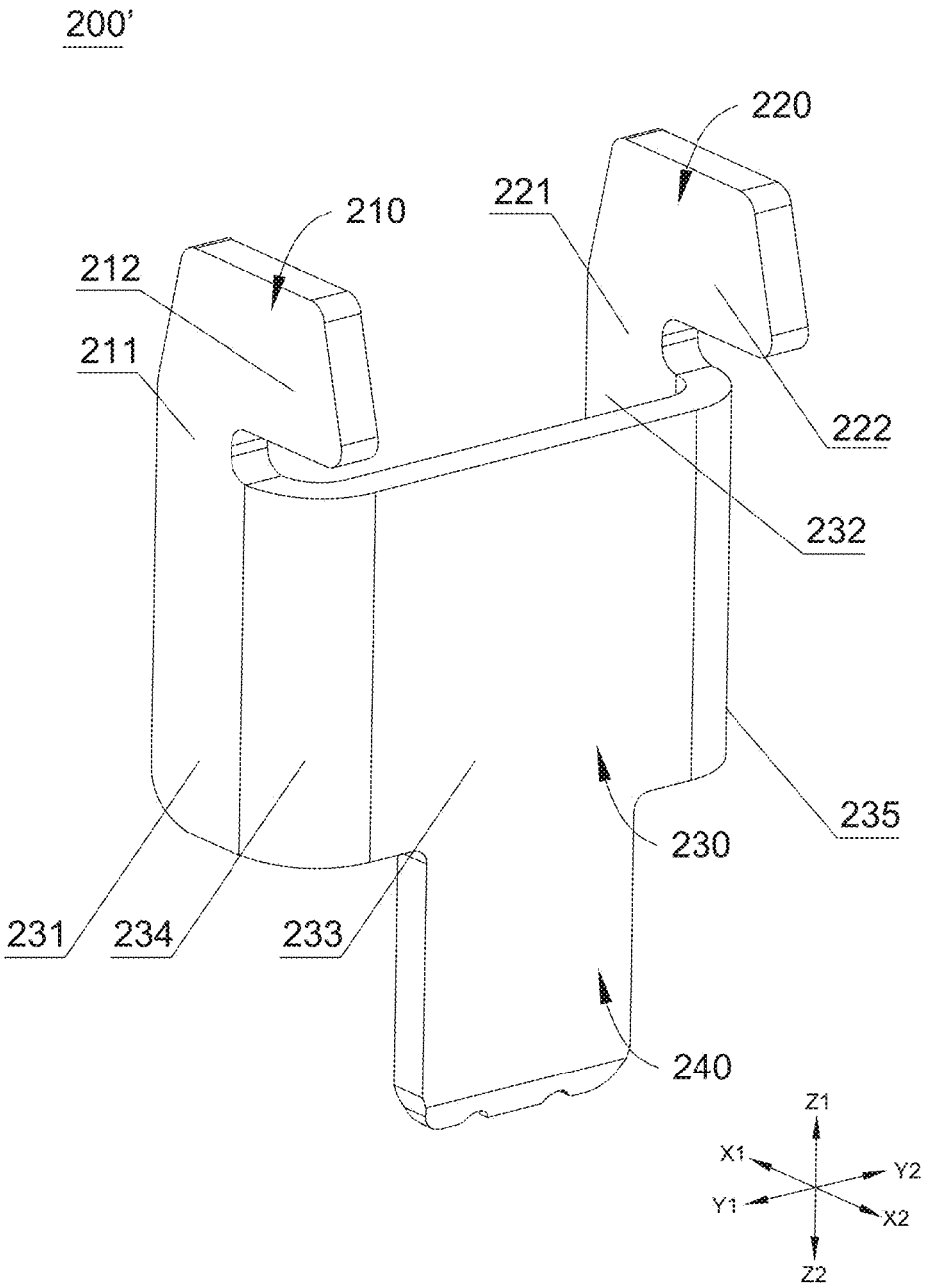
FIG. 8 is a perspective view of a reinforcing member according to another exemplary embodiment of the present disclosure.

In some embodiments, as shown in FIG. 8, the vertical height of the main body 230 of the reinforcing member 200' may be greater than those of the first connector engaging portion 210 and the second connector engaging portion 220. Since the main body 230 is the supporter for the first connector engaging portion 210 and the second connector engaging portion 220, increasing the vertical height of the main body 230 may improve the mechanical strength of the reinforcing member 200'. This arrangement is particularly applicable when the vertical height of the reinforcing member 200' is large.

The reinforcing member 200' is basically similar to the reinforcing member 200 in structure and their difference is mainly the size relationship between components. Therefore, the same or similar components in the reinforcing member 200' and the reinforcing member 200 use the same reference numbers, and the reinforcing member 200' will be described later in detail.

In some embodiments, as shown in FIG. 6, a connecting groove 323 may also be formed in the mounting surface 320. The connecting groove 323 may be communicated between the first slot 321 and the second slot 322. The connecting groove 323 may be perpendicular to the first slot 321 and the second slot 322. The connecting groove 323 may be connected to ends or middle parts of the first slot 321 and the second slot 322. The main body 230 may be inserted into the connecting groove 323. In this way, not only may the structural strength of the insulating body 300 be further enhanced, but also the electrical connector 100 provided with the reinforcing member 200 may be small in size and compact in structure.

In some embodiments in which the first slot 321 and the second slot 322 may be located at the partitioning rib 312, the connecting groove 323 is located in the partitioning rib 312. There is enough space for forming the connecting groove 323 in the partitioning rib 312, and the formation of the connecting groove 323 in the partitioning rib 312 has little effect on the structural strength of the insulating body 300.

In some embodiments, as shown in FIG. 6, the connecting groove 323 may have a first notch 325 and a second notch 326 opposite to each other. The first notch 325 and the second notch 326 may be located at the mounting surface 320, i.e., the first notch 325 and the second notch 326 are located at the opening of the connecting groove 323. The first notch 325 and the second notch 326 may be located in the middle part of the connecting groove 323 and may be of the same or different sizes. Since the insulating body 300 is usually manufactured by means of injection molding, on the one hand, the first notch 325 and the second notch 326 may enhance the strength of an injection molding workpiece, and prevent the injection molding workpiece from being skewed due to its excessive thinness, thereby better protecting the product size, and on the other hand, the first notch 325 and the second notch 326 may save the material of the insulating body 300 to reduce the cost.

Regarding the foregoing embodiment in which the second section 212 of the first connector engaging portion 210 extends beyond the first curved section 234 from the first section 211 and the fourth section 222 of the second connector engaging portion 220 extends beyond the second curved section 235 from the third section 221, as shown in FIG. 6, two ends of the connecting groove 323 may be respectively communicated with the middle parts of the first slot 321 and the second slot 322. Therefore, the connecting groove 323 of this structure may match with the structures of the first connector engaging portion 210 and the second connector engaging portion 220.

In some embodiments, as shown in FIG. 6, the depth of the connecting groove 323 may be smaller than those of the first slot 321 and the second slot 322. In this way, the connecting groove 323 may match with the main body 230, the first slot 321 and the second slot 322 may match with the first connector engaging portion 210 and the second connector engaging portion 220 respectively, the insulating body 300 does not need to be slotted any other, and thus, the structural strength of the insulating body is improved.

As shown in FIGS. 3 to 6, the mounting surface 320 may be provided with a protruding rib 324. The protruding rib 324 may effectively prevent the insulating body 300 from warping during injection molding so as to avoid structural deformation. The protruding rib 324 extends in an extending direction (i.e., the length direction) of the card slot 311. The first slot 321 and the second slot 322 are respectively located on both sides of the protruding rib 324. A distance between the first slot 321 and the second slot 322 equals the width of the protruding rib 324. The connecting groove 323 is formed in the protruding rib 324, and two ends of the main body 230 of the reinforcing member 200 are against the both sides of the protruding rib 324. With reference to FIG. 7, the first end section 231 and the second end section 232 of the main body 230 are respectively against the both sides of the protruding rib 324. The protruding rib 324 is sandwiched between the first end section 231 and the second end section 232 of the main body 230. Thus, the strength of the reinforcing member 200 may be maintained.

In some embodiments, as shown in FIG. 6, both the first slot 321 and the second slot 322 may be blind slots. In other words, neither the first slot 321 nor the second slot 322 runs through from the mounting surface 320 of the insulating body 300 to the interfacing surface 310 thereof. After assembly is completed, the openings of the first slot 321 and the second slot 322 face the circuit board and are blocked by the circuit board. If the first slot 321 and the second slot 322 are through slots, dust is easily deposited in the first slot 321 and the second slot 322 from the side where the interfacing surface 310 is located, since there is no shield on this side. The dust will become mildewed in moist air. If the moldy dust comes in contact with electrical elements on the circuit board, dangerous accidents such as burning of the electrical elements may be caused. With this arrangement, dust may be prevented from settling in the first slot 321, the second slot 322 and the connecting groove 323, and the safety of the electrical connector 100 may be improved. In addition, since the side where the interfacing surface 310 is located usually faces a user, the fact that the reinforcing member 200 does not extend to this side may maintain the integrity of the surface on this side and keep the appearance of the electrical connector 100 attractive.

Figure 9:
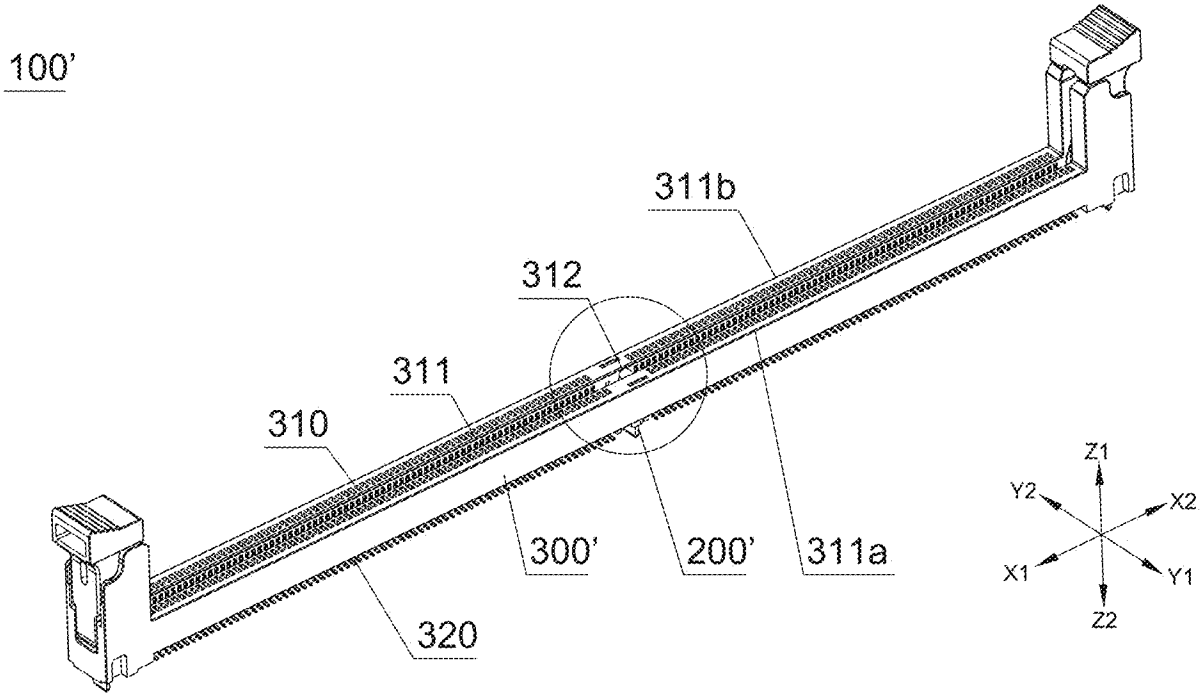
FIG. 9 is a perspective view of an electrical connector according to another exemplary embodiment of the present disclosure, in which a reinforcing member is mounted on an insulating body.
Figure 10:
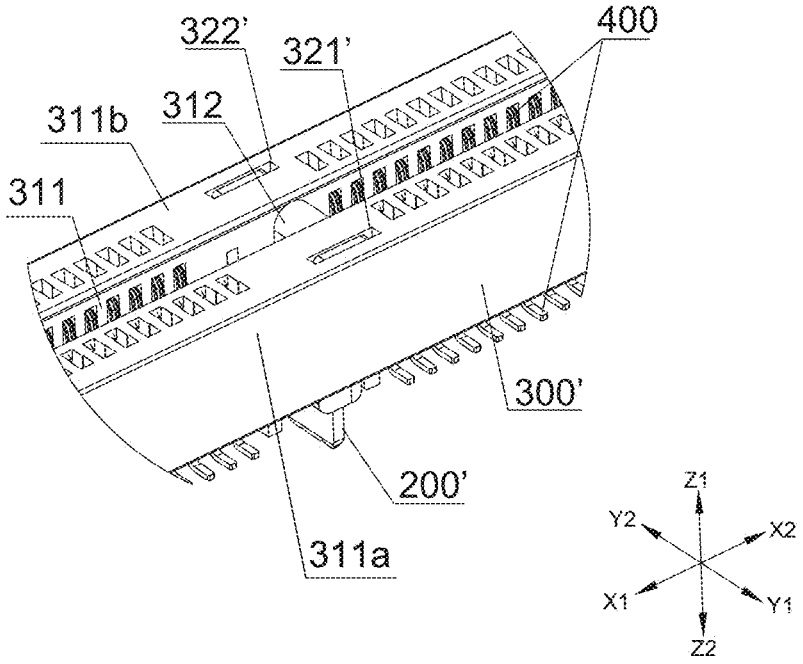
FIG. 10 is a partial enlarged view of the electrical connector shown in FIG. 9.

In some embodiments, as shown in FIGS. 9 to 10, the insulating body 300' may be provided with an interfacing surface 310 and a mounting surface 320 that are arranged opposite to each other in the vertical direction Z1-Z2. At least one of the first slot 321' and the second slot 322' may extend from the mounting surface 320 to the interfacing surface 310, i.e., at least one of the first slot 321' and the second slot 322' may run through the insulating body 300' in the vertical direction Z1-Z2. Correspondingly, the depth of the reinforcing member 200' inserted into the through slot of the first slot 321' and the second slot 322' (hereinafter referred to as insertion depth) is equivalent to the vertical height of the insulating body 300'. That is, the insertion depth may be slightly smaller than or equal to the vertical height of the insulating body 300'. "Slightly smaller" means that a difference between the vertical height and the insertion depth is less than or equal to 5 mm. In some embodiments, the difference between the vertical height and the insertion depth may be less than or equal to 3 mm, or less than or equal to 1.5 mm. In the shown embodiment, both the first slot 321' and the second slot 322' run through the insulating body 300'. Portions of the reinforcing member 200 inserted into the first slot 321' and the second slot 322' almost completely take up the first slot 321' and the second slot 322' respectively.

The reinforcing member 200' runs through the insulating body 300' and may strengthen the side walls 311*a* and 311*b* of the card slot 311 over the entire vertical height of the insulating body 300', thereby greatly improving the strength of the insulating body 300'. In addition, whether the reinforcing member 200' is properly mounted on the insulating body 300' may be checked from the interfacing surface 310.

Other than the first slot 321' and the second slot 322', the insulating body 300 described above is basically the same as the insulating body 300'. Therefore, the same reference numbers are assigned to the same or similar components in the insulating body 300 and the insulating body 300', and the insulating body 300' will be described later in detail.

As described above, since the reinforcing member 200' in this embodiment may be plugged into the insulating body 300' in a penetrating manner, the vertical height of the reinforcing member 200' is relatively larger. The reinforcing member 200' is selected to improve the strength of the electrical connector. Certainly, if necessary, the reinforcing member 200 may also replace the reinforcing member 200'.

Figure 11:
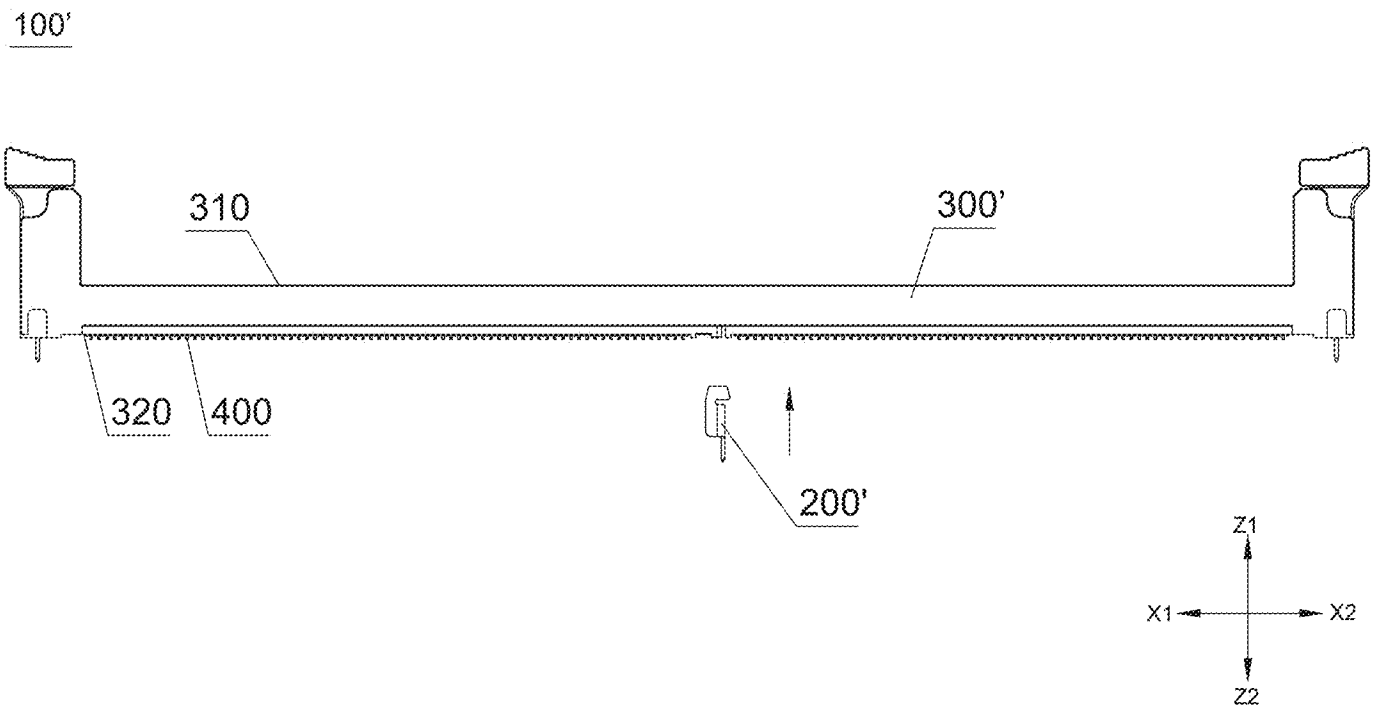
FIG. 11 is a front view of the electrical connector shown in FIG. 9, in which the reinforcing member has not been mounted on the insulating body.
Figure 12:
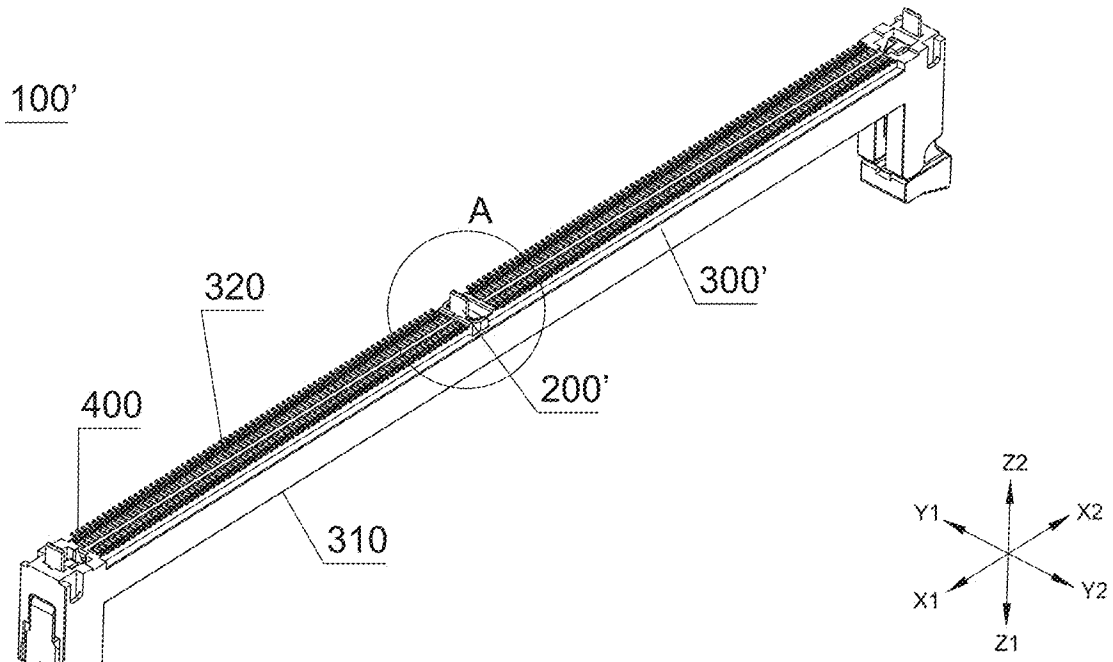
FIG. 12 is another perspective view of the electrical connector shown in FIG. 9.
Figure 13:
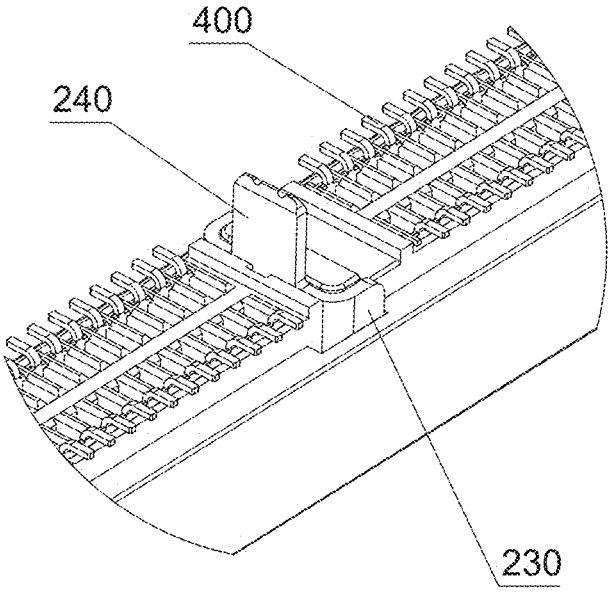
FIG. 13 is a partial enlarged view of the electrical connector shown in FIG. 12.

In some embodiments, referring to FIGS. 9 to 13, the reinforcing member 200' may be plugged into the first slot 321' and the second slot 322' from the mounting surface 320, i.e., the reinforcing member 200' is plugged into the first slot 321' and the second slot 322' in the first vertical direction Z1. The arrow shown in FIG. 11 schematically shows the direction in which the reinforcing member 200' is plugged into the insulating body 300'. The reinforcing member 200' may be plugged until it is close to or flush with the interfacing surface 310. The reinforcing member 200' does not extend beyond the insulating body 300' from the interfacing surface 310, avoiding adversely affecting insertion of the electronic card. In addition, since the side where the interfacing surface 310 is located generally faces the user, the fact that the reinforcing member 200' does not extend beyond this side may maintain a smooth surface on this side and keep the appearance of the electrical connector 100' attractive. Moreover, as will be described below, the reinforcing member 200' may also be provided with a board engaging portion 240. In the case that the board engaging portion 240 is provided, the reinforcing member 200' is plugged from below to facilitate arrangement of the board engaging portion 240.

Optionally, since the first slot 321' and the second slot 322' run through the insulating body 300' in the vertical direction Z1-Z2, the reinforcing member 200' may also be plugged into the first slot 321' and the second slot 322' from the interfacing surface 310, i.e., the reinforcing member 200' is plugged into the first slot 321' and the second slot 322' in the second vertical direction Z2.

In some embodiments, as shown in FIG. 8, the reinforcing member 200' may include a main body 230, a first connector engaging portion 210 and a second connector engaging portion 220. The first connector engaging portion 210 and the second connector engaging portion 220 may extend from the main body 230 in the first vertical direction Z1. Exemplarily, the first connector engaging portion 210 and the second connector engaging portion 220 may be connected with the main body 230 by means of, for example, welding, bonding, etc., or may be integrally formed with the main body 230. The first connector engaging portion 210 and the second connector engaging portion 220 may be spaced apart to form the two ends of the reinforcing member 200' and inserted into the first slot 321' and the second slot 322' respectively.

The main body 230, the first connector engaging portion 210 and the second connector engaging portion 220 may be located within the same plane or different planes. In some embodiments, the first connector engaging portion 210 and the second connector engaging portion 220 have larger sizes in the longitudinal direction X1-X2 than those in the transverse direction Y1-Y2, as shown in FIG. 8. Compared with an impact force in the longitudinal direction X1-X2, an impact force in the transverse direction Y1-Y2 is more likely to damage the card slot 311. The larger the sizes of the first connector engaging portion 210 and the second connector engaging portion 220 in the longitudinal direction X1-X2 are, the greater the resistance to the impact force in the transverse direction Y1-Y2 is. Therefore, the insulating body 300' may be better protected from cracking.

In order to receive the first connector engaging portion 210 and the second connector engaging portion 220, the first connector engaging portion 210 and the second connector engaging portion 220 are respectively inserted into the first slot 321' and the second slot 322' from the side where the mounting surface 320 is located. The first slot 321' and the second slot 322' may structurally match with the first connector engaging portion 210 and the second connector engaging portion 220 respectively, so that the first connector engaging portion 210 and the second connector engaging portion 220 may be limited in position after being respectively inserted into the first slot 321' and the second slot 322'.

Since the first connector engaging portion 210 and the second connector engaging portion 220 have larger size in the longitudinal direction X1-X2 than those in the transverse direction Y1-Y2, the side walls 311*a* and 311*b* of the card slot 311 may be strengthened better, which improves the impact resistance, particularly the resistance to the impact force in the transverse direction Y1-Y2. Therefore, the insulating body 300' is protected against deforming or cracking to a certain extent.

Further, as shown in FIG. 8, the reinforcing member 200' may further include a board engaging portion 240. The board engaging portion 240 may extend from the main body 230 in the second vertical direction Z. The board engaging portion 240 may extend beyond the insulating body 300' from the mounting surface 320. Exemplarily, the board engaging portion 240 may be connected with the main body 230 by means of, for example, welding, bonding, etc., or may be integrally formed with the main body 230. The main body 230, the first connector engaging portion 210, the second connector engaging portion 220, and the board engaging portion 240 may be located within the same plane or different planes. The board engaging portion 240 may be inserted into the circuit board. For example, an engaging hole may be formed in the circuit board. The board engaging portion 240 of the reinforcing member 200' may be inserted into the engaging hole.

The conductive terminals 400 are mounted in the side walls 311*a* and 311*b* of the card slot 311, as shown in FIG. 10. The card slot 311 exposes parts of the conductive terminals 400. In the case that the electronic card is plugged into the card slot 311, the exposed portions of the conductive terminals 400 may be electrically connected to a conductive contact of the electronic card. The conductive terminals 400 also extend to the mounting surface 320. In the case that the insulating body 300' is mounted on the circuit board, the conductive terminals 400 may be electrically connected to circuits in the circuit board. Thus, the conductive contacts of the electronic card are electrically connected to the circuits on the circuit board.

The conductive terminals 400 extend out from the mounting surface 320 of the electrical connector 100', as shown in FIGS. 10 to 13. By welding the conductive terminals 400 to the circuit board, the electrical connector 100' may be electrically connected to the circuit board. However, since the conductive terminals 400 are generally small, the structural strength at the welds is generally not high, and the welds are easy to be broken under the impact of an external force. By inserting the board engaging portion 240 of the reinforcing member 200' into the circuit board, such as an engaging hole in the circuit board, the strength of connection between the electrical connector 100' and the circuit board may be enhanced to ensure that the electrical connector 100' and the circuit board are firmly connected. At the same time, the electrical connector 100 may also be located on the circuit board to guarantee an accurate alignment between the conductive terminal 400 and points on the circuit board to be welded. Moreover, when the electronic card is connected to the circuit board by the electrical connector 100', impact forces on the electronic card and the insulating body 300' may be transmitted to the circuit board, effectively preventing the insulating body 300 from deforming and cracking under the impact forces.

Therefore, the reinforcing member 200' provided with the board engaging portion 240 may not only effectively protect the insulating body 300' of the electrical connector 100' against deformation or even damage but also strengthen the connection between the electrical connector 100' and the circuit board to ensure their stable connection. Since the reinforcing member 200' itself is multifunctional and is convenient for mounting, the assembly period may be shortened and the product cost may be lowered.

In some embodiments, as shown in FIG. 8, the reinforcing member 200' may be of the following structure: the main body 230 of the reinforcing member 200' may include an intermediate section 233, a first end section 231 and a second end section 232. The first end section 231 and the second end section 232 are connected to two ends of the intermediate section 233 respectively. The first end section 231 and the second end section 232 may be connected with the intermediate section 233 by means of, for example, welding, bonding, etc., or may also be integrally formed with the intermediate section 233. The intermediate section 233 may extend in the transverse direction Y1-Y2. The first end section 231 and the second end section 232 may extend in the longitudinal direction X1-X2. In this way, viewed in the vertical direction Z1-Z2, the main body 230 is substantially C-shaped.

In an embodiment in which the reinforcing member 200' includes the board engaging portion 240, the board engaging portion 240 may be connected to the intermediate section 233. The first connector engaging portion 210 and the second connector engaging portion 220 may be connected to the first end section 231 and the second end section 232 respectively. With this arrangement, the structural strength of the main body 230 is increased, so that the reinforcing member 200' has a better protective effect on the insulating body 300' of the electrical connector 100'. As shown in FIG. 8, optionally, the board engaging portion 240 may extend in the transverse direction Y1-Y2. In this way, the reinforcing member 200' is small in size, more compact in structure, and convenient to process and manufacture. At the same time, the first connector engaging portion 210 and the second connector engaging portion 220 extend in the same direction as the card slot 311, such that the first connector engaging portion 210 and the second connector engaging portion 220 may resist the impact force within a longer size range in the length direction of the card slot 311. Thus, the mechanical strength of the insulating body 300' may be effectively improved, and the insulating body 300' may be protected better.

In some embodiments, as shown in FIG. 8, a first curved section 234 may be connected between the first end section 231 and the intermediate section 233. The first end section 231 and the intermediate section 233 are perpendicular to each other, and the first curved section 234 may serve as a rounded transition section between the first end section 231 and the intermediate section 233. In some embodiments, a second curved section 235 may be connected between the second end section 232 and the intermediate section 233. The second end section 232 and the intermediate section 233 are perpendicular to each other, and the second curved section 235 may serve as a rounded transition section between the second end section 232 and the intermediate section 233. The first curved section 234 and the second curved section 235 may have any radius of curvature. In this way, the main body 230 may be easily formed by a single plate and thus is low in production cost.

Optionally, as shown in FIG. 8, the first connector engaging portion 210 may be L-shaped and may include a first section 211 and a second section 212 that are perpendicular to each other. The first section 211 extends in the vertical direction Z1-Z2 and may be connected to the first end section 231. The second section 212 extends towards and beyond the intermediate section 233 in the longitudinal direction X1-X2 (i.e., extends in a direction indicated by the arrow X2). In this way, the first connector engaging portion 210 is big enough in the longitudinal direction X1-X2 and may play a favorable strengthening role to the insulating body 300'. Certainly, the second section 212 may also extend from the first section 211 in a direction indicated by the arrow X1. However, compared with such an embodiment, the reinforcing member 200' shown in FIG. 8 saves more raw materials when manufactured by a plate. In some embodiments, the second section 212 and the first curved section 234 may be spaced apart in the vertical direction Z1-Z2. In this way, in the case that the reinforcing member 200' or the main body 230 is formed by a single plate, it may be conveniently manufactured by bending the plate to form the first curved section 234. Moreover, the straight first connector engaging portion 210 may be guaranteed during bending, which is convenient to form a slot in the relatively thin side wall 311*a* of the card slot 311 for receiving the first connector engaging portion 210.

Optionally, the second connector engaging portion 220 may be L-shaped and may include a third section 221 and a fourth section 222 that are perpendicular to each other. The third section 221 extends in the vertical direction Z1-Z2 and may be connected to the second end section 232. The fourth section 222 extends towards and beyond the intermediate section 233 in the longitudinal direction X1-X2 (i.e., extends in a direction indicated by the arrow X2). In this way, the second connector engaging portion 220 is big enough in the longitudinal direction X1-X2 and may play a favorable strengthening role to the insulating body 300'. Certainly, the fourth section 222 may also extend from the third section 221 in a direction indicated by the arrow X1. However, compared with such an embodiment, the reinforcing member 200' shown in FIG. 8 saves more raw materials when manufactured by a plate. In some embodiments, the fourth section 222 and the second curved section 235 may be spaced apart in the vertical direction Z1-Z2. In this way, in the case that the reinforcing member 200' or the main body 230 is formed by a single plate, it may be conveniently manufactured by bending the plate to form the second curved section 235. Moreover, the straight second connector engaging portion 220 may be guaranteed during bending, which is convenient to form a slot in the thin side wall 311*b* of the card slot 311 for receiving the second connector engaging portion 220. A distance between the second section 212 and the first curved section 234 may equal or unequal that between the fourth section 222 and the second curved section 235.

In some embodiments, as shown in FIGS. 9 and 10, in the longitudinal direction X1-X2, a partitioning rib 312 may be provided in the middle part of the card slot 311. The partitioning rib 312 is located in the card slot 311 and connects the two side walls 311*a* and 311*b* of the card slot 311. The electronic card has a notch that matches with the partitioning rib 312. The partitioning rib 312 is usually not arranged in the middle part of the card slot 311 in its length direction, so the partitioning rib 312 also has a foolproof function. When plugged into the card slot 311, the electronic card may shake and strike the side walls 311*a* and 311*b* of the card slot 311 and the partitioning rib 312 under the impact of an external force, which may cause the insulating body 300' to deform or even crack.

The first slot 321' and the second slot 322' may be located at the partitioning rib 312, and may be located on opposite sides of the partitioning rib 312 respectively. As mentioned above, the electronic card usually has a notch that matches with the partitioning rib 312, which may prevent the electronic card from being plugged in a wrong direction. At the same time, the partitioning rib 312 may also improve the structural strength of the card slot 311. When the insulating body 300' is impacted by an external force, the partitioning rib 312 may absorb part of the external force. The partitioning rib 312 is usually solid, and is of certain size in the length and width directions of the card slot 311. For some models of electrical connectors (e.g., an electrical connector for plugging a DDR5 memory card), the side walls 311*a* and 311*b* of the card slot 311 have relatively long solid sections at the partitioning rib 312, without any the conductive terminals 400. Therefore, in terms of space and structure, it provides conditions for forming the first slot 321' and the second slot 322' for receiving the reinforcing member 200' because of the partitioning rib 312. When the inventor made vibration and impact tests on a conventional electrical connector without the reinforcement member 200', it was found that crack would happen at the partitioning rib 312. Therefore, disposing the reinforcing member 200' at the partitioning rib 312 may enhance the strength of the insulating body 300'.

Certainly, for different models of electrical connectors, if spatially and structurally permitted, the first slot 321' and the second slot 322' may also be located at other positions of the insulating body 300' than at the partitioning rib 312. Besides, based on the structure of the insulating body 300', one or more reinforcing members 200' may be mounted thereon.

Figure 14:
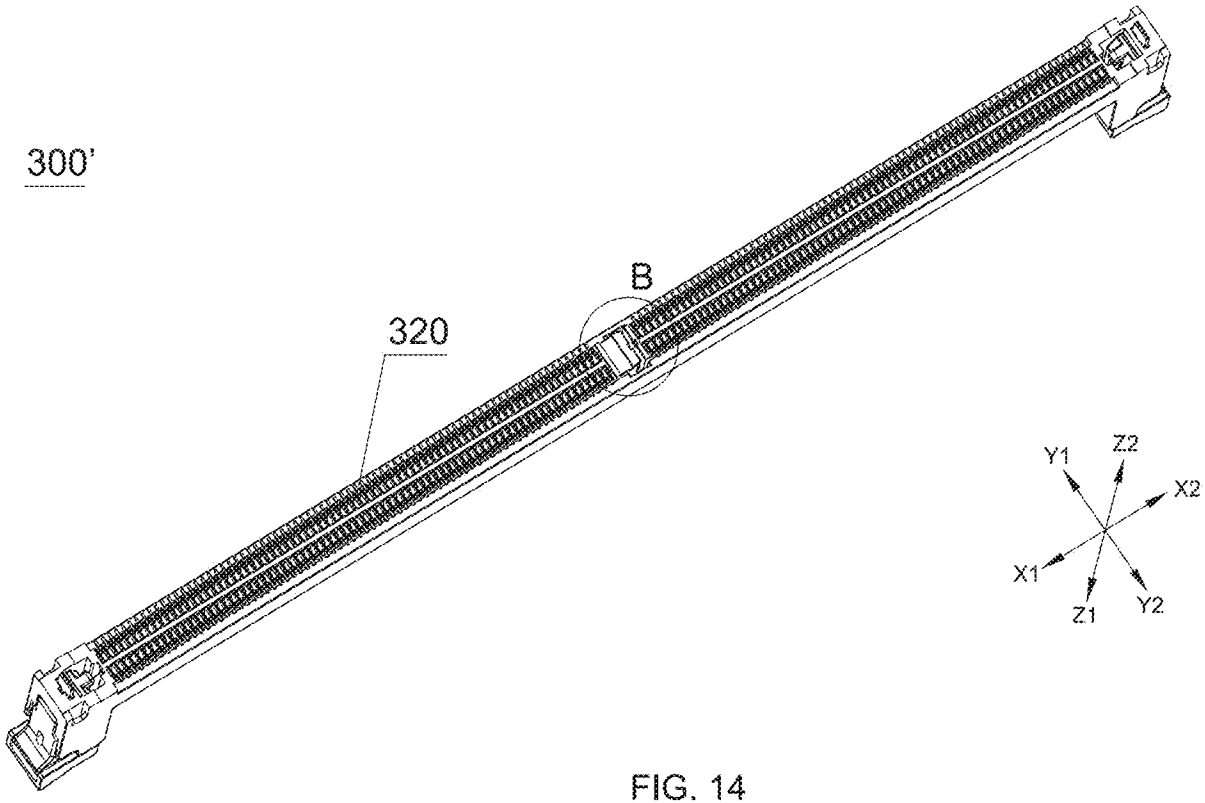
FIG. 14 is a perspective view of an insulating body of the electrical connector shown in FIG. 9.
Figure 15:
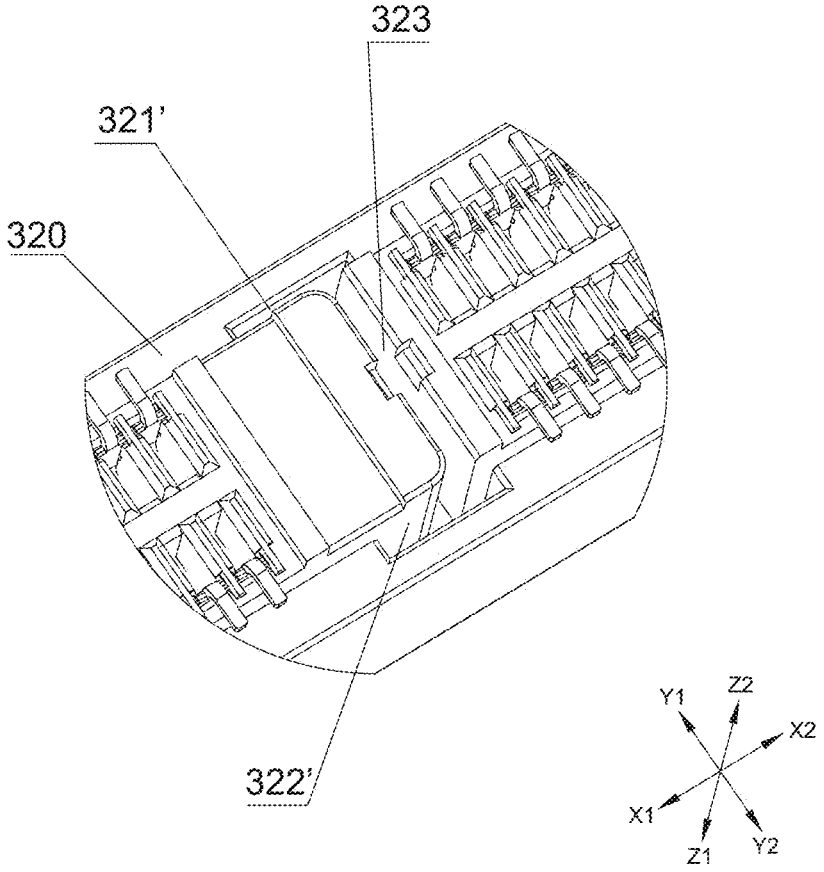
FIG. 15 is a partial enlarged view of the insulating body shown in FIG. 14.
Figure 16:
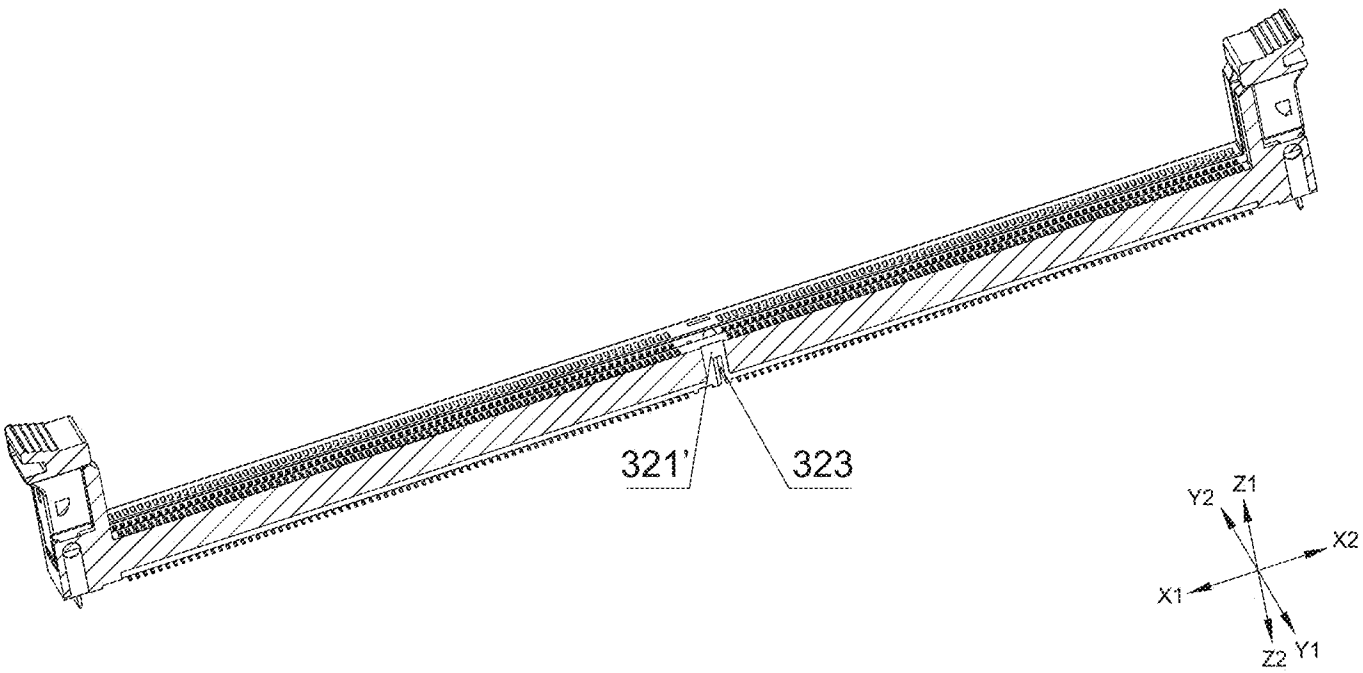
FIG. 16 is a section view of the insulating body shown in FIG. 14.

In an embodiment in which the reinforcing member 200' includes a main body 230, a first connector engaging portion 210 and a second connector engaging portion 220, as shown in FIGS. 14 to 16, a connecting groove 323 may be further formed in the mounting surface 320. The connecting groove 323 may be communicated between the first slot 321' and the second slot 322'. The connecting groove 323 may be perpendicular to the first slot 321' and the second slot 322'. Both ends of the connecting groove 323 may be communicated with any appropriate positions of the first slot 321' and the second slot 322'. The main body 230 may be inserted into the connecting groove 323. In this way, not only may the structural strength of the insulating body 300' be further enhanced, but also the electrical connector 100' provided with the reinforcing member 200' may be small in size and compact in structure.

For the aforementioned embodiment in which the second section 212 of the first connector engaging portion 210 extends beyond the intermediate section 233 from the first section 211 and the fourth section 222 of the second connector engaging portion 220 extends beyond the intermediate section 233 from the third section, as shown in FIGS. 14 to 15, in the longitudinal direction X1-X2, both ends of the connecting groove 323 may be respectively communicated with the middle parts of the first slot 321' and the second slot 322'. Therefore, the connecting groove 323 of this structure may match with the structures of the first connector engaging portion 210 and the second connector engaging portion 220 described above.

In some embodiments, as shown in FIG. 16, the vertical size of the connecting groove 323 may be greater than half of the vertical size of the first slot 321'. The vertical size of the connecting groove 323 may also be greater than half of the vertical size of the second slot 322'. In this way, the main body 230 may be of a relatively bigger vertical size to enhance the structural strength of the reinforcing member 200' itself, and the depth of the main body 230 inserted into the connecting groove 323 is also increased to better improve the structural strength of the insulating body 300'.

Having thus described several embodiments, it is to be appreciated various alterations, modifications, and improvements may readily occur to those skilled in the art. Such alterations, modifications, and improvements are intended to be within the spirit and scope of the invention. Accordingly, the foregoing description and drawings are by way of example only.

Various changes may be made to the illustrative structures shown and described herein. For example, a reinforcing member was described in connection with the card edge connector. A reinforcing member may be used in connection with any suitable electrical connectors, such as backplane connectors, daughter card connectors, stacking connectors, Mezzanine connector, I/O connector, chip socket, Gen Z connector, etc. These connectors have insufficient strength when they suffer from vibration and impact, while the reinforcing member can well enhance the strength of such connectors.

Furthermore, although many inventive aspects are shown and described with reference to a vertical connector, it should be appreciated that aspects of the present disclosure is not limited in this regard, as any of the inventive concepts, whether alone or in combination with one or more other inventive concepts, may be used in other types of electrical connectors, such as right angle connectors, coplanar electrical connectors, etc.

In the description of the present disclosure, it needs to be understood that the orientation or positional relationship indicated by the orientation terms such as "front", "rear", "upper", "lower", "left", "right", "transverse", "vertical", "perpendicular", "horizontal", "top", "bottom", etc. is usually based on the orientation shown in the drawings, and is only for the convenience of describing the present disclosure and simplifying the description. These orientation terms do not indicate or imply that the device or element has to have a specific orientation or be constructed and operated in a specific orientation, except as otherwise noted. Therefore, it cannot be understood as a limitation on the scope of the present invention. The orientation terms, "inside" and "outside", refer to the inside and outside relative to the contour of each component itself.

For ease of description, spatial terms, such as "above", "on", etc., can be used herein to describe the spatial relationship between one or more components or features shown in the drawings and other components or features. It should be understood that the spatial terms not only include the orientation of the components shown in the drawings, but also include other orientations in use or operation. For example, if the components in the drawings are inverted as a whole, a component "above other components or features" becomes to the component "below other a components or structures". Thus, the exemplary term "above" can include both orientations "above" and "below". In addition, these components or features can also be positioned at other different angles (for example, rotated by 90 degrees or other angles), and this disclosure intends to cover all of these situations.

It should be noted that the terms used herein are only for describing specific implementations, and are not intended to limit to the exemplary implementations according to the present application. As used herein, unless the context clearly indicates otherwise, the singular form is also intended to include the plural form. In addition, the use of "including", "comprising", "having", "containing", or "involving", and variations thereof herein, is meant to encompass the items listed thereafter (or equivalents thereof) and/or as additional items.

It should be noted that the terms "first" and "second" in the description, the claims and the drawings of the application are used to distinguish similar objects, and are not necessarily used to describe a specific sequence. It should be understood that numbers used in this way can be interchanged under appropriate circumstances so that the embodiments of the present disclosure described herein can be implemented in a sequence other than those illustrated or described herein.

What is claimed is:

1. A reinforcing member for an electrical connector, comprising a main body, a first connector engaging portion and a second connector engaging portion, wherein the first connector engaging portion and the second connector engaging portion extend from the main body in a first vertical direction and are spaced apart in a transverse direction, and the first connector engaging portion and the second connector engaging portion are configured to be engaged to opposite sides of a card slot of the electrical connector respectively and to extend in a direction parallel to an elongated dimension of the card slot.

2. The reinforcing member according to claim 1, wherein the main body comprises an intermediate section, a first end section and a second end section, the first end section and the second end section are connected to two ends of the intermediate section, the intermediate section extends in the transverse direction, the first end section and the second end section extend in a longitudinal direction, and the first connector engaging portion and the second connector engaging portion are connected to the first end section and the second end section respectively.

3. The reinforcing member according to claim 2, wherein a first curved section is connected between the first end section and the intermediate section, and a second curved section is connected between the second end section and the intermediate section.

4. The reinforcing member according to claim 3, wherein:

the first connector engaging portion is L-shaped and comprises a first section and a second section that are perpendicular to each other, the first section is connected to the first end section, and the second section extends towards the first curved section and is spaced apart from the first curved section; and the second connector engaging portion is L-shaped and comprises a third section and a fourth section that are perpendicular to each other, the third section is connected to the second end section, and the fourth section extends towards the second curved section and is spaced apart from the second curved section.

5. The reinforcing member according to claim 4, wherein:

the size of the first section is smaller than or equal to that of the first end section in the longitudinal direction; and/or the size of the third section is smaller than or equal to that of the second end section in the longitudinal direction.

6. The reinforcing member according to claim 4, wherein:

a maximum size of the first connector engaging portion is greater than the sum of the sizes of the first end section and the first curved section in the longitudinal direction; and/or a maximum size of the second connector engaging portion is greater than the sum of the sizes of the second end section and the second curved section in the longitudinal direction.

7. The reinforcing member according to claim 1, wherein a vertical height of the main body is greater than those of the first connector engaging portion and the second connector engaging portion.

8. The reinforcing member according to claim 1, further comprising a board engaging portion extending from the main body in a second vertical direction, wherein the second vertical direction is opposite to the first vertical direction, the board engaging portion is configured to be engaged to a circuit board that the electrical connector is connected thereto.

9. An electrical connector, comprising the reinforcing member of claim 1 in combination with an insulating body, wherein:

the insulating body comprises:

an interfacing surface and a mounting surface that are arranged opposite to each other in a vertical direction, a card slot extending in a longitudinal direction in the interfacing surface, and a first slot and a second slot in the mounting surface and respectively located on opposite sides of the card slot in the transverse direction, and the first connector engaging portion and the second connector engaging portion are inserted into the first slot and the second slot, respectively.

10. The electrical connector according to claim 9, wherein a partitioning rib is disposed in the card slot, and the first slot and the second slot are respectively located on opposite sides of the partitioning rib.

11. The electrical connector according to claim 9, wherein a connecting groove is formed in the mounting surface and communicates between the first slot and the second slot, and the main body is inserted into the connecting groove.

12. The electrical connector according to claim 11, wherein the mounting surface is provided with a protruding rib extending in a direction in which the card slot extends, the first slot and the second slot are respectively located on opposite sides of the protruding rib, a distance between the first slot and the second slot equals a width of the protruding rib, the connecting groove is formed in the protruding rib, and two ends of the main body are against the opposite sides of the protruding rib respectively.

13. The electrical connector according to claim 11, wherein the connecting groove has a first notch and a second notch that are opposite to each other, and the first notch and the second notch are formed at the mounting surface and in the middle part of the connecting groove.

14. The electrical connector according to claim 11, wherein a depth of the connecting groove is smaller than those of the first slot and the second slot.

15. The electrical connector according to claim 9, wherein at least one of the first slot and the second slot extends from the mounting surface to the interfacing surface.

16. An electrical connector, comprising:

an insulating body comprising:

an interfacing surface and a mounting surface that are arranged opposite to each other in a vertical direction, a card slot in the interfacing surface extending in a longitudinal direction, a first slot and a second slot in the insulating body, wherein the first slot and the second slot run through the insulating body in the vertical direction and are respectively located on opposite sides of the card slot in a transverse direction; and a U-shaped reinforcing member with its two ends in the first slot and the second slot respectively, wherein depth of the reinforcing member in the first slot and the second slot correspond to a vertical height of the insulating body.

17. The electrical connector according to claim 16, wherein a partitioning rib is disposed in the card slot, and the first slot and the second slot are respectively located on both sides of the partitioning rib.

18. The electrical connector according to claim 16, wherein the reinforcing member is plugged into the first slot and the second slot from the mounting surface.

19. The electrical connector according to claim 18, wherein the reinforcing member comprises a main body, a first connector engaging portion and a second connector engaging portion, the first connector engaging portion and the second connector engaging portion extend from the main body in a first vertical direction and are spaced apart in the transverse direction to form the two ends of the reinforcing member, the first connector engaging portion and the second connector engaging portion are respectively inserted into the first slot and the second slot, and the first connector engaging portion and the second connector engaging portion each has a greater size in the longitudinal direction than that in the transverse direction.

20. The electrical connector according to claim 19, wherein a connecting groove is formed in the mounting surface and communicated between the first slot and the second slot, and the main body is inserted into the connecting groove.

21. The electrical connector according to claim 20, wherein a vertical height of the connecting groove is greater than half of a vertical height of the first slot; and/or the vertical height of the connecting groove is greater than half of a vertical height of the second slot.

22. The electrical connector according to claim 19, wherein:

the reinforcing member further comprises a board engaging portion extending from the main body in a second vertical direction, the second vertical direction is opposite to the first vertical direction, and the board engaging portion extends out of the insulating body from the mounting surface and is configured to engage to a circuit board that the electrical connector is connected to.

23. An insulating body for an electrical connector, the insulating body comprising:

an interfacing surface and a mounting surface opposite to each other in a vertical direction, a card slot extending in a longitudinal direction in the interfacing surface, wherein the card slot is configured to receive an electronic card, and a first slot and a second slot in the mounting surface, extending in the longitudinal direction, and respectively located on opposite sides of the card slot in a transverse direction.

24. The insulating body according to claim 23, wherein the mounting surface is provided with a protruding rib extending in a direction in which the card slot extends, the first slot and the second slot are respectively located on both sides of the protruding rib, a distance between the first slot and the second slot equals a width of the protruding rib, and a connecting groove is communicated between the first slot and the second slot and formed in the protruding rib.

25. The insulating body according to claim 23, wherein at least one of the first slot and the second slot extends from the mounting surface to the interfacing surface.

26. A reinforcing member for an electrical connector, comprising a main body, a first connector engaging portion and a second connector engaging portion, wherein:

the first connector engaging portion and the second connector engaging portion extend from the main body in a first direction and are spaced apart in a transverse direction that is transverse to the first direction;

the first connector engaging portion and the second connector engaging portion are configured to be engaged to opposite sides of a card slot of an electrical connector respectively, the main body comprises an intermediate section, a first end section and a second end section;

the first end section and the second end section are connected to two ends of the intermediate section;

the intermediate section extends in the transverse direction;

the first end section and the second end section extend in a longitudinal direction that is perpendicular to the first direction and the transverse direction; and the first connector engaging portion and the second connector engaging portion are connected to the main body via the first end section and the second end section respectively.

* * * * *